US010228715B2

(12) United States Patent
Segarra

(10) Patent No.: US 10,228,715 B2
(45) Date of Patent: Mar. 12, 2019

(54) SELF-STARTING BANDGAP REFERENCE DEVICES AND METHODS THEREOF

(71) Applicant: Intrinsix Corp., Marlborough, MA (US)

(72) Inventor: Daniel J. Segarra, Southborough, MA (US)

(73) Assignee: Intrinsix Corp., Marlborough, MA (US)

( * ) Notice: Subject to any disclaimer, the term of this patent is extended or adjusted under 35 U.S.C. 154(b) by 0 days.

(21) Appl. No.: 16/041,193

(22) Filed: Jul. 20, 2018

(65) Prior Publication Data

US 2019/0025868 A1 Jan. 24, 2019

Related U.S. Application Data

(60) Provisional application No. 62/586,295, filed on Nov. 15, 2017, provisional application No. 62/534,726, filed on Jul. 20, 2017.

(51) Int. Cl.
*G05F 3/26* (2006.01)

(52) U.S. Cl.
CPC ..... *G05F 3/267* (2013.01)

(58) Field of Classification Search
CPC ..... G05F 3/02; G05F 3/08; G05F 3/10; G05F 3/16; G05F 3/20; G05F 3/22; G05F 3/24; G05F 3/26; G05F 3/262; G05F 3/265; G05F 3/267; G05F 3/30
USPC ..... 323/312, 313, 314, 315, 316, 317
See application file for complete search history.

(56) References Cited

U.S. PATENT DOCUMENTS 4,896,094 A * 1/1990 Greaves ..... G05F 3/267 323/314
6,016,051 A * 1/2000 Can ..... G05F 3/30 323/314
6,340,882 B1 * 1/2002 Chung ..... G05F 3/225 323/314

(Continued)

OTHER PUBLICATIONS

Banba, H., et al., "A CMOS Bandgap Reference Circuit With Sub-1-V Operation," IEEE J. Solid-State Circuits, vol. 34, May 1999.

(Continued)

*Primary Examiner* — Adolf Berhane
(74) *Attorney, Agent, or Firm* — LeClairRyan PLLC

(57) ABSTRACT

A self-starting bandgap reference circuit comprises a bias current source configured to provide a bias current. A bandgap core coupled to the bias current source includes a first device configured to receive the bias current and provide a first current output based on the bias current and a second device configured to receive the bias current and provide a second current output based on the bias current. A difference mirror coupled to the first device and the second device receives the first current output and the second current output and is configured to provide a difference current between the second current output and the first current output that is a proportional-to-absolute temperature current. A voltage reference output and a current reference output coupled to the difference mirror receives the proportional-to-absolute temperature current and provides a voltage reference and a current reference based on the proportional-to-absolute temperature current.

18 Claims, 19 Drawing Sheets

(56) References Cited

U.S. PATENT DOCUMENTS

| | | | | |
|---|---|---|---|---|
| 6,501,256 | B1 * | 12/2002 | Jaussi | G05F 3/30 323/315 |
| 6,853,164 | B1 * | 2/2005 | Prinz | G05F 3/30 320/119 |
| 7,567,071 | B1 * | 7/2009 | Tsinker | H03K 3/011 323/316 |
| 7,965,129 | B1 * | 6/2011 | Wadhwa | G05F 1/463 327/513 |
| 2009/0058384 | A1 * | 3/2009 | Taniguchi | G05F 3/30 323/282 |
| 2009/0160538 | A1 * | 6/2009 | Marinca | G05F 3/30 327/539 |
| 2013/0099769 | A1 * | 4/2013 | Fan | G05F 3/242 323/312 |
| 2014/0015509 | A1 * | 1/2014 | Gupta | G05F 3/30 323/313 |
| 2015/0002130 | A1 * | 1/2015 | Kumar | G05F 3/30 323/313 |
| 2015/0205319 | A1 * | 7/2015 | De Cremoux | H02M 3/18 331/109 |
| 2018/0101190 | A1 * | 4/2018 | Lee | G05F 3/30 |

OTHER PUBLICATIONS

Brokaw, A. P., "A Simple Three-Terminal IC Bandgap Reference," IEEE J. Solid-State Circuits, vol. SC-9, No. 6, Dec. 1974.

Brugler, J. S., "Silicon Transistor Biasing for Linear Collector Current Temperature Dependence," IEEE J. Solid-State circuits, vol. SC-2, Jun. 1967.

Gilbert, B., "Accurate Design of Low-Voltage, Low-Power, Monolithic References," MEAD Design Course, San Jose, CA 1996.

Gray, P. R. et al, "Analysis and Design of Analog Integrated Circuits, Fourth Edition," John Wiley & Sons, Inc. 2001.

Hilbiber, D. F., "A New Semiconductor Voltage Standard," International Solid-State Circuits Conference, Feb. 19, 1964.

Kuijk, K. E., "A Precision Reference Voltage Source," IEEE J. Solid-State Circuits, vol. SC-8, Jun. 1973.

Song, B. S., et al., "A Precision Curvature-Compensated CMOS Bandgap Reference," IEEE J. Solid-State Circuits, vol. SC-18, Dec. 1983.

Tsividis, Y. P., "Accurate Analysis of Temperature Effects in Ic-VBE Characteristics with Application to Bandgap Reference Sources," IEEE J. Solid-State Circuits, vol. SC-15, Dec. 1980.

Widlar, R. J., "New Developments in IC Voltage Regulators," IEEE J. Solid-State Circuits, vol. SC-6, Feb. 1971.

* cited by examiner

SELF-STARTING BANDGAP REFERENCE DEVICES AND METHODS THEREOF

This application claims the benefit of U.S. Provisional Patent Application Ser. No. 62/534,726, filed Jul. 20, 2017 and Ser. No. 62/586,295, filed Nov. 15, 2017, which are hereby incorporated by reference in their entirety.

FIELD

This technology relates to self-starting bandgap reference devices and methods of use thereof.

BACKGROUND

Bandgap references are widely utilized in integrated circuits to produce a fixed voltage to serve as a reference. The voltage remains constant regardless of power supply variations, temperature changes, and circuit loading from a device. Conventional bandgaps create a current source with the core bipolar devices and cross-couple this source with a current mirror.

Bandgap references are based on temperature behavior of the base-emitter voltage (VBE) of a bipolar junction transistor. When biased in a stable manner, VBE falls with increasing temperature. Thus, VBE is said to have a temperature behavior that is Complimentary to Absolute Temperature (CTAT). Two identical devices having different current densities will have VBE values that fall with temperature at different predictable slopes. These characteristic curves will both converge at zero degrees Kelvin. The difference between the VBE values of the two devices with different current densities (ΔVBE) increases with temperature. This characteristic is said to be Proportional to Absolute Temperature (PTAT). The appropriate scaling and summation of PTAT and CTAT voltages, produces a voltage that is substantially temperature independent. This serves as the basis for basic bandgap reference techniques.

In most bandgap references, ΔVBE is created by biasing identical devices with different emitter junction areas with either currents of the same magnitude or currents of a stable integer ratio. The created ΔVBE is generally impressed across a resistor to generate a current that is PTAT, which is then scaled by the required factor using a resistor of the same type and added to the VBE to create the reference output voltage. The ΔVBE generator is often referred to as the "bandgap core." The bandgap core that produces the ΔVBE provides a PTAT current source, such that the core current is PTAT. It is convenient in bandgap implementations, to mirror this core PTAT current from one core bipolar transistor to the other. Mirroring the core PTAT current is performed using a current mirror, a feedback circuit, or both. Since the circuit is stable wherever the current-verses-voltage transfer functions of the current source and mirror cross each other, standard bandgap references have a stable state at zero current which produces zero output voltage.

More specifically, A bipolar junction transistor collector current is given by the following equation:

$$IC=Is*\exp(VBE/Vt) \quad (1)$$

wherein, IC is the collector current, Is is the scale current, VBE is the base-emitter voltage, and Vt is the thermal voltage. Vt is determined by the following equation:

$$Vt=KT/q \quad (2)$$

wherein, K is Boltzmann's constant, T is the temperature in Kelvin, and q is the electronic charge.

Solving equation (1) for base-emitter voltage yields the following equation:

$$VBE=Vt*\ln(IC/Is) \quad (3)$$

For two devices with different base-emitter voltages, the difference between the VBE values for the two devices, i.e., ΔVBE, is given by the following equation:

$$\Delta VBE=(VBE1-VBE2) \quad (4)$$

Combining equations (3) and (4) provides:

$$\Delta VBE=Vt*\ln(IC1/Is1)-Vt*\ln(IC2/Is2)=Vt*\ln\ [(IC1/IC2)*(Is2/Is1)] \quad (5)$$

Where IC1 and Is1 are the collector current and scale current for the first device and IC2 and Is2 are the collector current and scale current for the second device.

For identical devices, the scale current is proportional only to the emitter area. Therefore, equation (5) becomes:

$$\Delta VBE=Vt*\ln\ [(IC1/IC2)*(AE2/AE1)] \quad (6)$$

wherein AE1 and AE2 are the emitter areas for the first and second devices, respectively. For practical matching considerations, area ratios are achieved in standard fashion by replication of unit devices. Ratio m results from m devices ratioed with a single device. Thus, equation (6) becomes:

$$\Delta VBE=Vt*\ln\ [(IC1/IC2)*(m)] \quad (7)$$

In equation (7), only the collector current ratio (IC1/IC2), not its magnitude, is important. For devices driven at the same current, equation (7) becomes:

$$\Delta VBE=Vt*\ln(m) \quad (8)$$

Equation (8) is independent of collector current. The ΔVBE expression in equation (8) has all of the VBE-characterizing parameters eliminated, leaving only a simple ratio (m) and the thermal voltage Vt. As provided in Gilbert, "Monolithic Voltage and Current References: Theme and Variations" MEAD Design Course, San Jose, Calif. (1996), equation (8) provides the basis for producing a temperature dependent voltage that is quite fundamental (not empirical). The temperature dependent voltage is proportional to temperature regardless of the absolute value of the operating currents, doping profiles, junction areas, transistor polarity (NPN or PNP), or even the material type (Si, Ge, SIGe, or even Schottky junctions). Only Boltzmann's constant and the charge on an electron and are involved.

Most bandgap references create a current source with the ΔVBE core and cross-couple this source with a current mirror that is balanced either by the mirror itself, or an amplifier servo-loop, or both. This is convenient and reduces curvature slightly, but introduces an undesired zero-current state. Since standard bandgap reference techniques have an undesired zero-current or zero-voltage state, they require a start-up circuit for operation. Although many successful start-up circuits have been developed, they are difficult to design and notoriously difficult to evaluate with complete confidence over all conditions. Start-up circuits also introduce delay in start-up for the bandgap reference circuit.

SUMMARY

A self-starting bandgap reference circuit comprises a bias current source configured to provide a bias current. A bandgap core is coupled to the bias current source. The bandgap core includes a first device configured to receive the bias current and provide a first current output based on the bias current and a second device configured to receive the bias current and provide a second current output based on the bias current. A difference mirror is coupled to the first device and the second device to receive the first current output and the second current output. The difference mirror is configured to provide a difference current between the second current output and the first current output, wherein the difference current is a proportional-to-absolute temperature current. A voltage reference output and a current reference output are coupled to the difference mirror to receive the proportional-to-absolute temperature current and provide a voltage reference and a current reference based on the proportional-to-absolute temperature current.

A method of making a self-starting bandgap reference circuit comprises providing a bias current source configured to provide a bias current. A bandgap core is coupled to the bias current source. The bandgap core includes a first device configured to receive the bias current source and provide a first current output based on the bias current and a second device configured to receive the bias current and provide a second current output based on the bias current. A difference mirror is coupled to the first device and the second device to receive the first current output and the second current output. The difference mirror is configured to provide a difference current between the second current output and the first current output, wherein the difference current is a proportional-to-absolute temperature current. A voltage reference output and a current reference output are coupled to the difference mirror to receive the proportional-to-absolute temperature current and provide a voltage reference and a current reference based on the proportional-to-absolute temperature current.

This technology provides a circuit that provides a stable voltage reference that is independent of supply voltage and temperature. The circuit forms the basis for Analog-to-Digital conversion, as well as a basis to create stable power supply voltages and bias currents. The circuit provides a single stable state when powered with no undesired zero-current or zero-voltage state, thus eliminating the requirement for a start-up circuit. Specifically, the circuits of the present technology put the core devices in current drive with a sure-starting current source.

The circuits of the present technology advantageously provide a particular voltage value in situations where supply power is unreliable or intermittent, such as in RF energy scavenging systems. Additionally, the circuits of the present technology are not susceptible to having their operating state upset from a disturbance. This means the circuits are radiation tolerant, i.e., they have no false state that they can be tripped into, when implemented in an appropriate process. The technology may advantageously be employed in both bipolar and CMOS technologies.

As set forth in equation (8) above, the PTAT signal ΔVBE is dependent on only a fixed ratio and fundamental constants. Most bandgap references create a current source with the ΔVBE core and cross-couple this source with a current mirror which is balanced either by the mirror itself, or an amplifier servo-loop, or both. This is convenient and reduces curvature slightly, but introduces an undesired, zero-current state. By contrast, the circuits of the present technology drive the collector currents of the core bipolar junction transistors, which in turn creates an accurate value current source from a rough value current source—with the important additional feature that no undesired, zero-current state is possible as the core bias is generated by an independent current source. Therefore no start-up circuit is required. The problem that remains is to extract the ΔVBE signal so that it can be properly scaled and added to the CTAT signal (VBE) and ground referenced. This problem is solved in several different ways in the exemplary circuits below.

The present technology recognizes that the ΔVBE generator is independent of current magnitude over decades of bias current. This holds as long as the core devices carry the same current or currents with a fixed ratio relationship. In the present technology, instead of mirroring the core device currents one to the other, both bipolar junction transistors are put in current drive by independent current sources that are stable, produced in a predictable ratio, and have no zero current state. It is not necessary that this bias current be PTAT or even fixed as long as the ratio is stable and it is bound over extremes of process, temperature, power supply voltage, and mismatch to avoid low extremes, where leakage errors can be problematic and to avoid high currents where high level injection can be problematic or parasitic resistance can destroy log conformity. Errors due to decreasing beta are also avoided with moderate bias currents.

A second problem addressed by the exemplary circuits of the present technology is extracting the ΔVBE PTAT voltage so that it can be scaled and added to the VBE CTAT voltage. The standard bandgap circuit uses a core mirror so the signal of interest is simply mirrored out. The present technology provides a number of exemplary solutions for this problem. One solution applies the ΔVBE to a source-coupled pair modified by placing a resistor between the sources. In addition, simple servo amplifiers drive the gate-source of each device in the pair in order to reduce matching errors. In this case, the PTAT current is developed in the source coupling resistor. This current appears in the drain of one source-coupled pair device so that it can be mirrored out. This first method is compatible with both CMOS and BiCMOS technologies.

A second exemplary solution for extracting the ΔVBE includes creating current sources with each of the bipolar transistors that deliver a current of VBE divided by a resistor. These current sources take in the rough bias current and reliably deliver a controlled current VBE/R. These VBE based currents are then bucked against each other in a current mirror to generate the required difference current which has the PTAT signature.

A third exemplary solution uses the VBE of the core devices as inputs to an operational amplifier based voltage-to-current converter, bucks the resulting currents to generate the PTAT current, and drives this current through the output branch in the standard manner. This circuit is also CMOS compatible.

DETAILED DESCRIPTION

Figure 1:
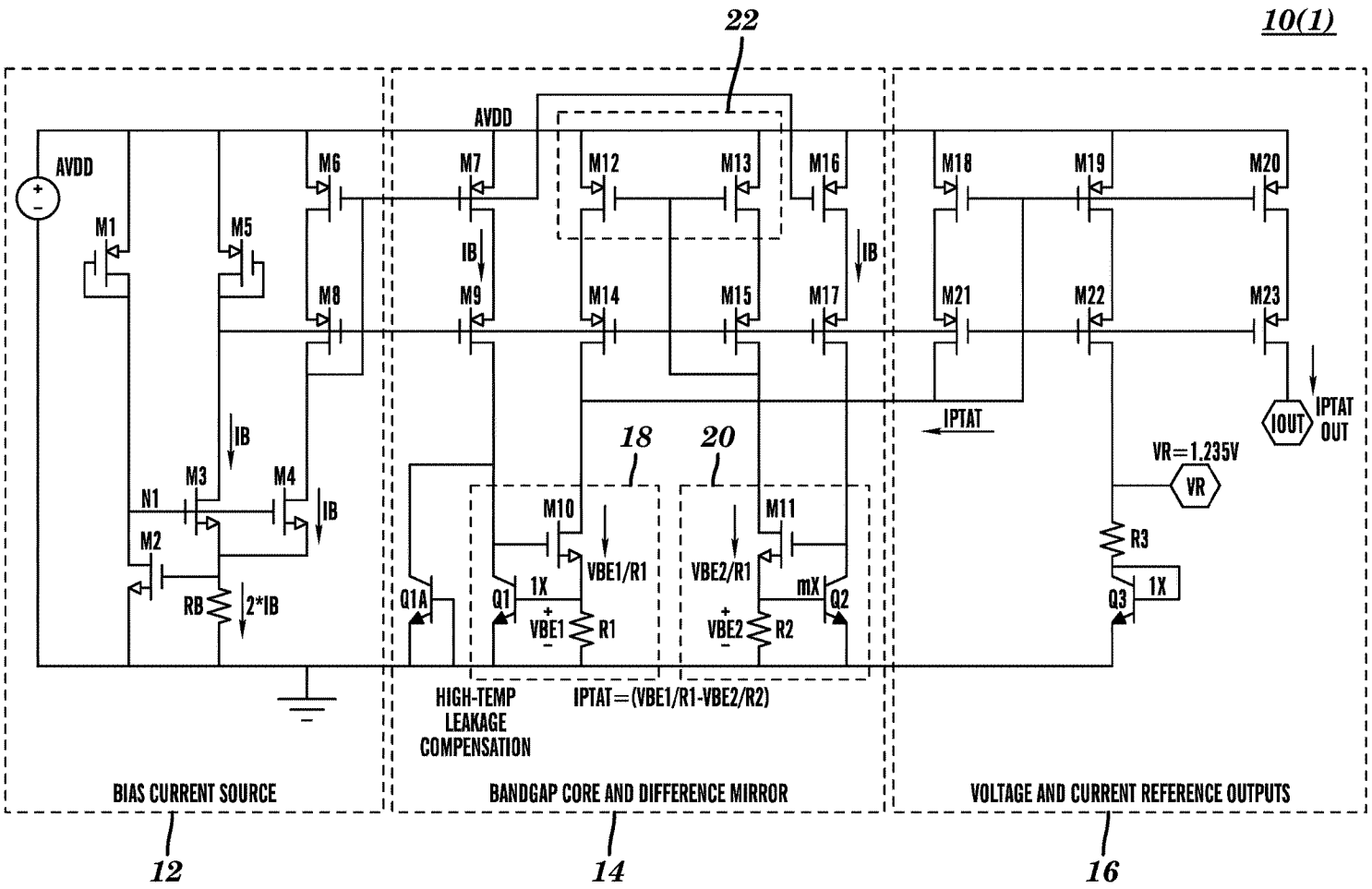
FIG. 1 is a circuit diagram of an exemplary BiCMOS self-starting bandgap reference circuit.

An example of a self-starting bandgap reference circuit 10(1) that may be employed with a BiCMOS integrated circuit device, by way of example, is illustrated in FIG. 1. In this particular example, the self-starting bandgap reference circuit 10(1) includes portions of the circuit that provide a bias current source 12, a bandgap core and difference mirror 14, and a voltage and current reference output 16, although the self-starting bandgap reference circuit may include other types and/or numbers of other systems, devices, components, and/or other elements in other configurations. The self-starting bandgap reference circuit 10(1) may advantageously be employed in integrated circuits for providing a stable voltage reference that is independent of supply voltage and temperature, with no undesired zero-current or zero-voltage state, thus eliminating the requirement for a start-up circuit, i.e., the circuit is self-starting.

Referring again to FIG. 1, the bias current source 12 of the exemplary self-starting bandgap reference circuit 10(1) is configured to provide a self-starting bias current. In this example, the bias current source 12 is a CMOS threshold based current reference that is sure-starting, although other bias current source circuits may be employed. The bias current source 12 is configured to provide a rough, but stable, current source to drive the core devices as described further below. In this example, the bias current source 12 is configured to generate two bias currents to place two separate core devices in current drive. Bias current sources such as used in the exemplary self-starting bandgap reference circuit 10(1) illustrated in FIG. 1 are well known in the art.

The BiCMOS self-starting bandgap reference circuit 10(1) illustrated in FIG. 1 further includes the bandgap core and difference mirror 14 portion of the circuit coupled to the bias current source 12 to receive the stable, self-starting current. The bandgap core and difference mirror 14 includes a first device 18 and a second device 20 to provide first and second current outputs, respectively, and a difference mirror 22.

In this example, the first device 18 and the second device 20 comprise bipolar junction transistors Q1 and Q2. The first device 18 includes Q1, M10, R1, and the second device 20 includes Q2, M11, and R2 and act as current sources. The first device 18 and the second device 20 are three terminal NPN devices, although other core devices may be employed. The first device 18 and the second device 20, in this example bipolar junction transistors, are configured to turn the rough current from the bias current source 12 into a complimentary to absolute temperature (CTAT) current as an output. The first device 18 and the second device 20 of the bandgap core and difference mirror 14 portion of the circuit are configured such that the first current output and the second current output are proportional to a first base emitter voltage (VBE1) for the first device 18 and a second base emitter voltage (VBE2) for the second device 20, as described in further detail below. More specifically, in this example, the first current output is equal to the first base emitter voltage divided by the resistance of resistor R1 in the first device 18 and the second current output is equal to the second base emitter voltage divided by the resistance of resistor R2 in the second device 20. In one example, the resistors R1 and R2 are configured to provide an equal resistance.

In this example, the second device 20 (including Q2) has a greater emitter area than the first device 18 to create a current difference. In this example, the emitter areas of the second device 20 and the first device 18 have an 8:1 ratio, although other ratios may be employed. The circuit is configured such that the first current output is delivered to an input of the difference mirror 22 and the second current output is delivered to an output of the difference mirror 22 as shown in FIG. 1.

The core devices (first device 18 and second device 20) in the bandgap core and difference mirror 14 portion are coupled to the difference mirror 22 (including M12-M13) as illustrated in FIG. 1. The difference mirror 22 is coupled to the first device 18 (Q1, M10, R1) and the second device 20 (Q2, M11, and R2) to receive the first current output and the second current output. The difference mirror 22 is configured to provide a difference current, as described in further detail below, between the two current outputs that, in this example, is a proportional-to-absolute temperature (PTAT) current.

The BiCMOS self-starting bandgap reference circuit 10(1) further includes a circuit portion that provides the voltage and current reference output 16. As shown in FIG. 1, the voltage reference and current reference output 16 is coupled to the difference mirror 22 to receive the PTAT current. The voltage reference and current reference output 16 portion provides a stable reference for use with other integrated circuits, in this example a BiCMOS circuit, as described in further detail below. The voltage reference and the current reference output 16 provides a standard bandgap output.

An exemplary operation of the self-starting bandgap reference circuit 10(1) illustrated in FIG. 1 will now be described. In this example, bias current source 12 provides a rough, self-starting current. The PMOS diode M1 of the bias current source 12 pulls up on VT based current source M2-M3-RB to generate two bias currents, each labeled IB (2*IB=VT/RB), where VT is the NMOS threshold voltage. Next, the drain of M3 in the bias current source 12 delivers IB to PMOS cascode bias diode M5 and the drain of M4 delivers IB to mirror M6-M7-M16 which drives this current into the collectors of the first device 18 comprising Q1, R1, M10 and the second device 20 comprising Q2, R2, M11.

Next, the second device 20 comprised of Q2, R2, and M11 produces the current output VBE2/R2 which is delivered to the input of difference mirror 22 (M12-M13). The first device 18 comprised of Q1, R1, and M10 produces the second current output VBE1/R1, which is bucked against the output of the M12-M13 difference mirror 22. In this example, Q2 of the second device 20 has factor m greater emitter area than Q1 of the first device, such that the difference of the M10, M11 currents is given by the equation:

$$\mathrm{IPTAT}=(VBE1/R1-VBE2/R2) \tag{9}$$

In this example, Vgs(M13) is set equal to Vgs(M18) so that current sources M10 and M11 will see the same compliance. This causes these current sources to turn on at the same supply voltage so that there is no overshoot of VR as the supply voltage comes up. This matching also reduces errors caused by finite current source output impedance. The NPN current source devices M10 and M11 will benefit from native or low Vt devices. This will lower required power supply voltage and incur no liability.

The PTAT current (IPTAT) is delivered to mirror M18-M19-M20 the voltage and current reference output 16. The PTAT current is driven into R3-Q3 to produce the bandgap output voltage in standard fashion. M20 provides a PTAT reference output current. The PTAT gain is set by the ratio R3/R1. The voltage and current references provided by the voltage and current reference output 16 may be utilized in any application in which bandgap reference circuits are employed. In this example, the references may be utilized in a BiCMOS application.

Bandgap circuits having core devices biased with PTAT currents are advantageous as compared with those biased with T-stable or CTAT currents. As provided in Gilbert, "Monolithic Voltage and Current References: Theme and Variations" MEAD Design Course, San Jose, Calif. (1996), an expression for base-emitter voltage often used in precision bipolar design appears below:

$$VBE(H,Ic)=EGE-H(EGE-VBEN)+VTN*H*\log(Ic/In)-\eta*VTN*H*\log(H) \tag{10}$$

wherein, VBE is the base-emitter voltage as a function of temperature (H) and collector current (Ic) (H=T/Tn, where T is the temperature in Kelvin and Tn is the design center temperature), EGE is the Y-intercept (extrapolated value at zero Kelvin), VBEN is the base-emitter voltage at the design center current In and temperature Tn, and VTN is the thermal voltage at the design center temperature (K*Tn/q).

The term H(EGE−VBEN) in Equation (10) is the linear CTAT term (Complimentary to Absolute Temperature), the term VTN*H*log(Ic/In) is the log dependence on collector current, and the term H*log(H) models curvature with temperature, where η is the exponent of temperature in the scale current expression Is(T) and is the SPICE parameter XTI (2 to 4 typical).

For a conventional bandgap reference, with PTAT (Proportional to Absolute Temperature) core currents, the collector currents can be expressed as:

$$Ic=\lambda H*In \tag{11}$$

where $\lambda$=Ic/In at design temperature $T_n$. Since log(a*b)=log(a)+log(b), the third term in equation (10) can be expressed as:

$$VTN*H*\log(\lambda*H)=VTN*H*(\log(\lambda)+\log(H)) \tag{12}$$

Inserting Equation (12) into Equation (10) gives:

$$VBE(H,Ic)=Ege-H(Ege-Vben-Vtn\log(\lambda))-(\eta-1)VtnH(\log H) \tag{13}$$

In comparing Equation (13) with Equation (9) it is apparent that a benefit of PTAT bias is that it reduces the curvature factor from η to (η−1).

The simple and reliable, independent bias current source 12 used as a basis for core current drive for first device 18 and second device 20 is essentially a modified Wilson current mirror, with the diode connected device replaced by a resistor. It is a feedback circuit with a small loop-gain that makes it quite stable. Sensitivity to power supply variations are given by the equation:

$$S=(VDD/I\mathrm{out})*(dI\mathrm{out}/dVDD)=(Vov/2*Vgs)*\mathrm{Sin}/VDD \tag{14}$$

wherein, Vov is the mosfet overdrive voltage (Vgs−Vt), Vgs is the gate-source voltage and Sin/VDD is roughly unity for supply voltages significantly greater than Vgs as set forth in P. R. Gray, et al., "Analysis and Design of Analog Integrated Circuits, Fourth Edition" John Wiley & Sons, Inc. (2001), the disclosure of which is hereby incorporated herein by reference in its entirety. This evaluates to roughly 0.05 for typical devices. There is a significant further reduction in power supply sensitivity because the independent current source of the bias current source 12 biases the bipolar junction transistor based current sources (first device 18 and second device 20), the output currents of which in turn are subtracted to produce the voltage reference output branch current of the voltage and current reference output 16. This creates a significant improvement in the power supply rejection ratio (PSRR).

Figure 2:
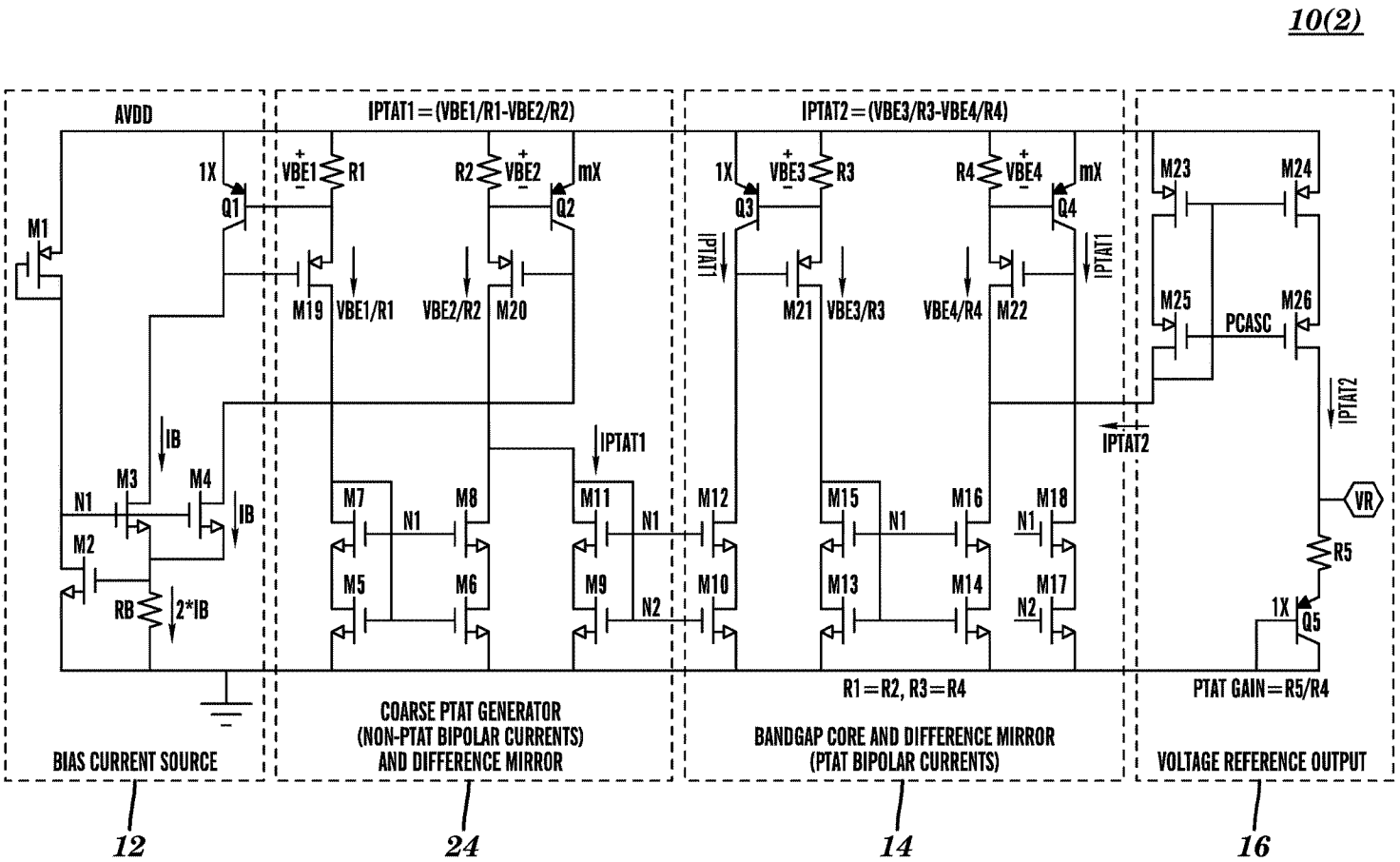
FIG. 2 is a circuit diagram of an exemplary BiCMOS Self-Starting Bandgap self-starting bandgap reference circuit with a PTAT core current for reduced curvature.

FIG. 2 illustrates another exemplary embodiment of a self-starting bandgap reference circuit 10(2) of the present technology. The self-starting bandgap reference circuit of FIG. 2 is the same in structure and operation as the self-starting bandgap reference 10(1) of FIG. 1 except as described below. In the example illustrated in FIG. 2, a coarse PTAT generator 24 is added between the bias current source 12 portion and the bandgap core and difference mirror 14 portion of the self-starting bandgap reference circuit 10(2). The PTAT current generator 24 is coupled to the bias current source 12 to receive the bias current and provide a pair of PTAT current outputs. The pair of PTAT current outputs bias the bandgap core currents with PTAT currents in order to reduce curvature and to improve accuracy of the self-starting bandgap reference circuit 10(2) illustrated in FIG. 2.

Figure 3:
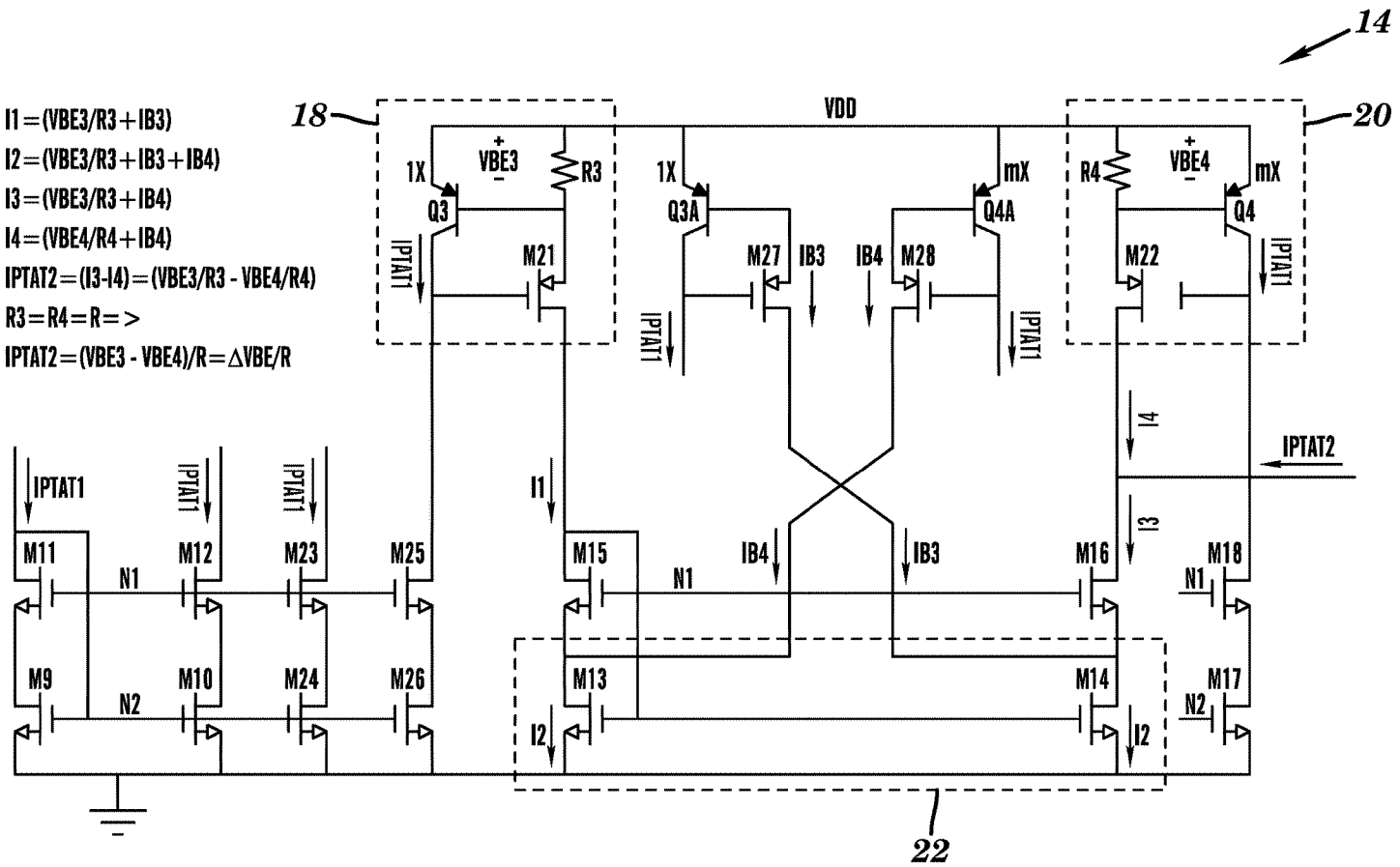
FIG. 3 is a circuit diagram of an alternative example of a bandgap core including base current compensation that may be employed with the self-starting bandgap reference circuit of FIG. 1 or FIG. 2.

FIG. 3 illustrates an alternative example of a bandgap core and difference mirror 14 that may be employed in either the self-starting bandgap reference circuit 10(1) of FIG. 1 the self-starting bandgap reference circuit 10(2) of FIG. 2 of the present technology. The bandgap core and difference mirror 14 portion illustrated in FIG. 3 utilizes BiCMOS self-starting bandgap core base current compensation to improve accuracy. The band-gap core and difference mirror 14 illustrated in FIG. 3 may serve as a direct replacement for the cores illustrated in the circuits of FIG. 1 or FIG. 2 when greater accuracy is needed and has the same structure and operation except as described below.

In this example, the bandgap core and difference mirror 14 includes PNP bipolar transistor junctions Q3A and Q4A that are biased at the same level as PNP bipolar transistor junctions Q3 and Q4 of the first device 18 and the second device 20. This causes their base currents to track those of the core. These base currents are cross-coupled and injected into the PTAT current differencing mirror 22 (M13-M14) such that they subtract the original base currents. In this manner this current difference mirror 22 serves both functions so additional mismatch is not introduced. In addition, the difference mirror 22 operates at collector current magnitudes rather than significantly lower base current magnitudes, so difference mirror accuracy is improved. Nearly the same accuracy can be obtained by making Q3A and Q4A 1× devices as the base currents will be nearly identical at identical collector currents.

Figure 4:
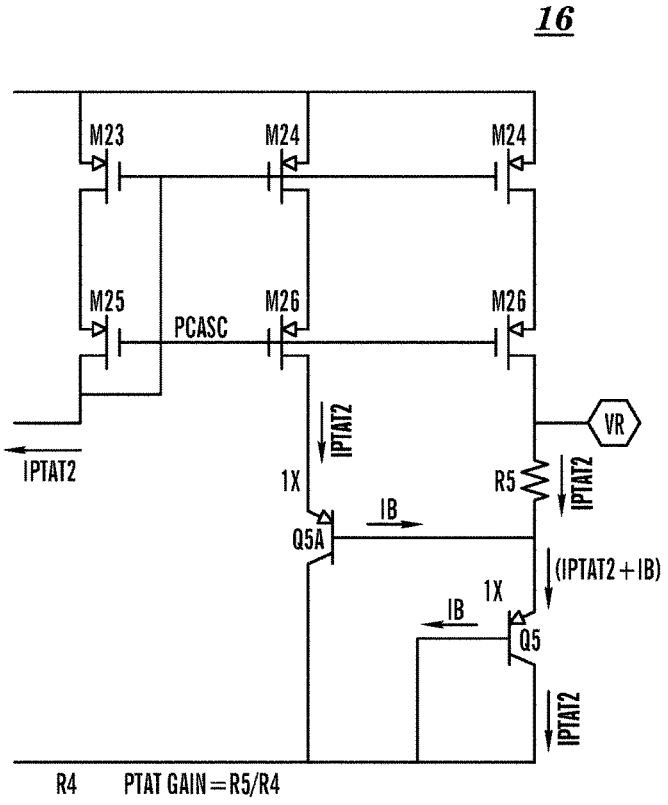
FIG. 4 is a circuit diagram of an alternative example of a base current compensation circuit that may be employed with the self-starting bandgap reference circuit of FIG. 1 or FIG. 2.

FIG. 4 illustrates an alternative example of the voltage and current reference output 16 portion of the circuit that may be utilized with the exemplary self-starting bandgap reference circuit 10(1) of FIG. 1 or the self-starting bandgap reference circuit 10(2) of FIG. 2. In this example, the voltage and current reference 16 employs an output branch base current compensation as is well known in the art of bandgap reference circuits. In this example, Q5A tracks the current of output transistor Q5, increasing the emitter current of the output transistor Q5 by a nearly identical base current IB. This makes up for IB lost from output transistor Q5 so that the VBE determining collector current of output transistor Q5 is equal to the current in R5 as required.

Figure 5:
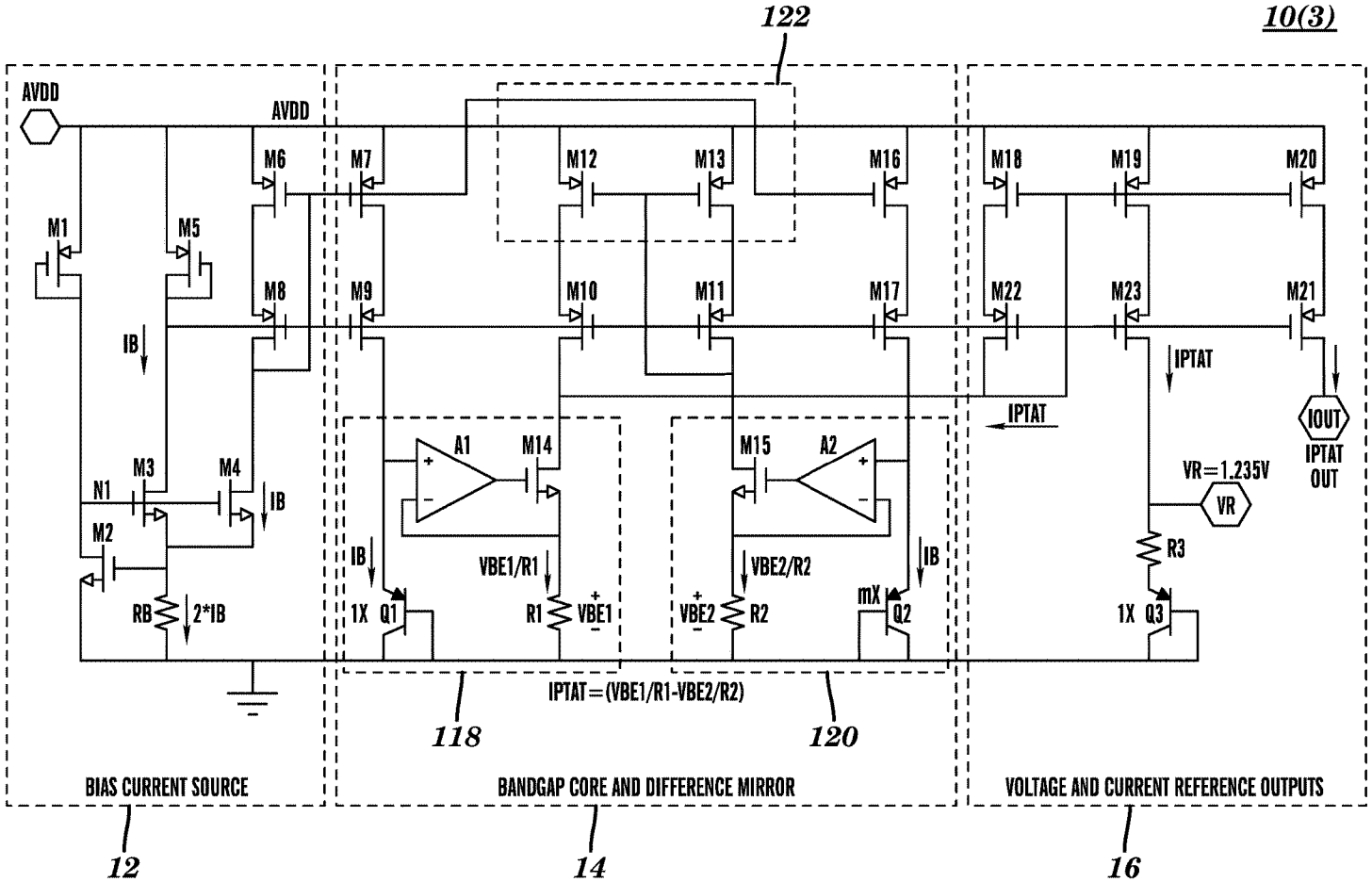
FIG. 5 is a circuit diagram of an exemplary CMOS self-starting bandgap reference circuit.

Referring now to FIG. 5, a CMOS self-starting bandgap reference circuit 10(3) is illustrated. The self-starting bandgap reference circuit 10(3) of FIG. 5 is the same in structure and operation as the self-starting bandgap reference circuit 10(1) illustrated in FIG. 1 except as described below. The exemplary circuit 10(3) of FIG. 5 may be employed, by way of example, in CMOS applications that require a bandgap reference. In this example, the bias current source 12 is the same as described with respect to FIG. 1. The PMOS diode M1 of the bias current source 12 pulls up on VT based current source M2-M3-RB to generate two bias currents, each labeled IB (2*IB=VT/RB), where VT is the NMOS threshold voltage. The drain of M3 delivers IB to PMOS cascode bias diode M5, while the drain of M4 delivers IB to mirror M6-M7-M16 which drives this current into emitters of substrate PNP's Q1 and Q2.

In this example, the bandgap core and difference mirror 14 portion of the circuit outlines two current sources, first device 118 and second device 120, proportional to VBE1 and VBE2, along with a difference mirror 122 that creates the difference in these currents, which is a PTAT current. The second device 120, which provides a current source, is comprised of Q2, R2, A2 and M15 and produces current VBE2/R2 which is delivered to the input of difference mirror 122 (M12-M13). The first device 118, comprised of Q1, R1, A1 and M14, produces current VBE1/R1, which is bucked against the output of difference mirror 122 (M12-M13). In this example, Q2 has factor m greater emitter area than Q1. The difference of the M14, M15 currents is given by the equation:

$$\text{IPTAT}=(VBE1/R1-VBE2/R2) \tag{15}$$

The PTAT gain in this example is set by the ratio R3/R1. Vgs(M13) is set equal to Vgs(M18) so that current sources M14 and M15 will see the same compliance. This causes these current sources to turn on at the same supply voltage so that there is no overshoot of VR as the supply voltage comes up. This matching also reduces errors due to finite current source output impedance. NMOS current source devices M14 and M15 included in first device 118 and second device 120, respectively, will benefit from native or low Vt devices. This will lower required power supply voltage and incur no liability.

In this example, the voltage and current reference output 16 provides the PTAT current delivered to mirror M18-M19-M20. The PTAT current is driven into R3-Q3 to produce the bandgap output in standard fashion. M20 provides a PTAT reference output current.

Figure 6:
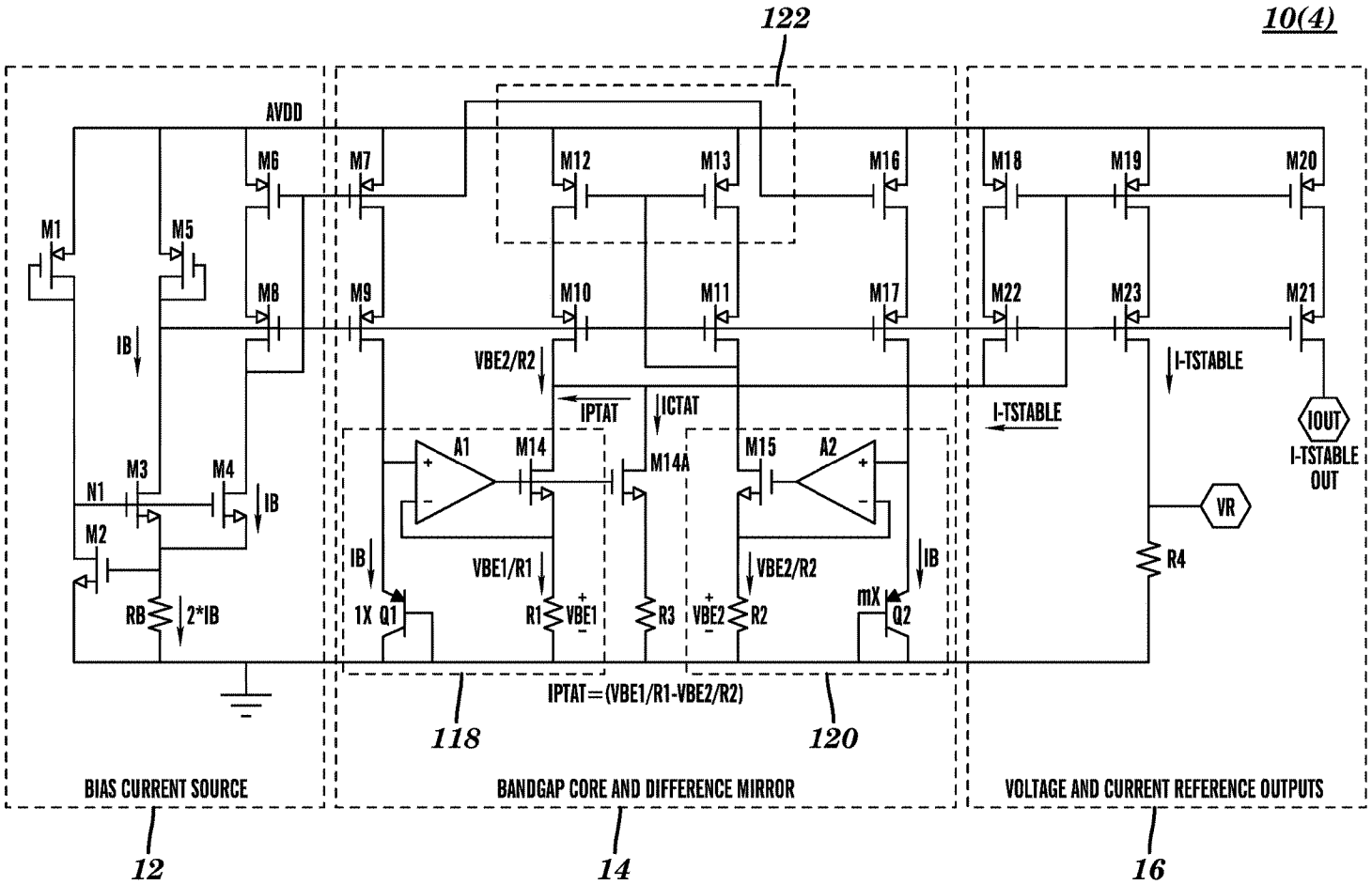
FIG. 6 is a circuit diagram of an exemplary modification of the CMOS self-starting bandgap reference circuit illustrated in FIG. 5 that provides a fractional bandgap reference circuit.

FIG. 6 illustrates a modified version of the circuit 10(3) in FIG. 5 that provides a fractional CMOS self-starting bandgap reference circuit 10(4). The bias current source 12 is identical to that shown in FIG. 1. In this example, the bandgap core and difference mirror, instead of mirroring out the PTAT current and driving it into a gain resistor stacked on a 1×PNP, the VBE/R1 current of M14 is scaled and mirrored in M14A. This CTAT current is added to the PTAT current in a proportion that produces a temperature-stable current (I-TSTABLE). In the voltage and current reference output 16, the core T-STABLE current is mirrored in M18-M19 and driven through R4. The output resistor R4 can be sized to create any convenient reference voltage magnitude as long as it's within the compliance of the output mirror.

Figure 7:
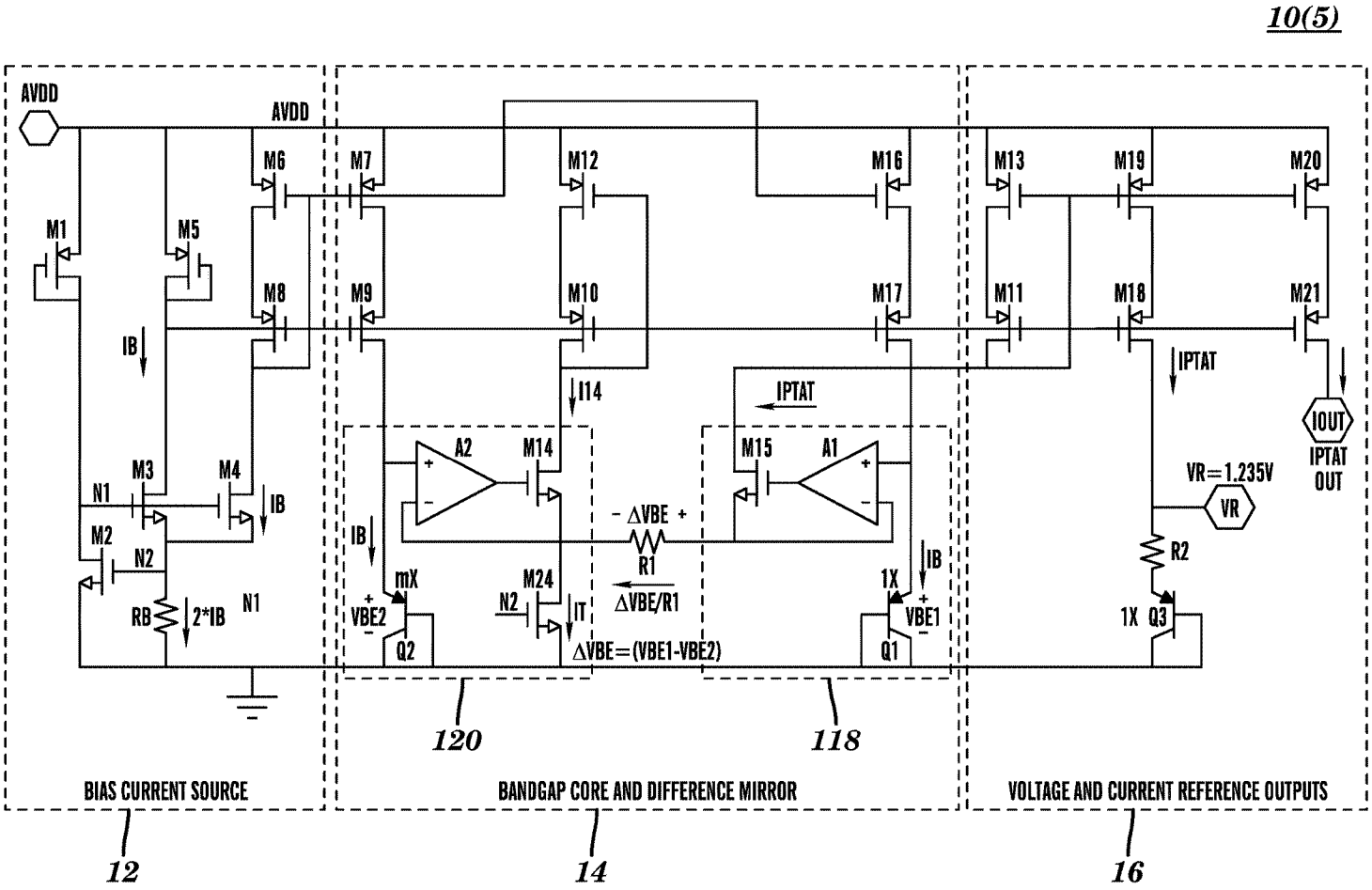
FIG. 7 is a circuit diagram of another exemplary modification of the CMOS self-starting bandgap reference circuit illustrated in FIG. 5.

FIG. 7 illustrates a CMOS source-coupled version of an exemplary self-starting bandgap reference circuit 10(5). The bias current source 12 is identical to that shown in FIG. 1. In this example, the bandgap core and difference mirror 14 provides a source-coupled pair that is formed by M14 of the first device 118 and M15 of the second device 120, except that resistor R1 is placed between the first device 118 and the second device 120. Opamps A1 and A2 drive the gates of the pair (M14-M15) such that the voltage applied to their non-inverting inputs appears at the sources of the pair (across R1). The emitter-base voltage of Q1 (VBE1) of the first device 118 is applied to A1 while the emitter-base voltage of Q2 (VBE2) of the second device 120 is applied to A2. Since The Q2 has factor m greater emitter area than Q1, the result is that the difference ΔVBE=(VBE1−VBE2) appears across R1 creating a PTAT current at the resistor R1. The tail current (IT) is greater than the PTAT current so that a standing current flows through M14 of the first device 118, keeping the source-coupled pair (M14-M15) biased. This current is essentially thrown away through diode M12 which is included to balance drain voltages on the source-coupled pair of first device 118 and second device 120 including M14 and M15, respectively. The PTAT gain is set by the ratio R2/R1.

In this example, Vgs(M12) is set equal to Vgs(M13) so that current sources M14 and M15 of the first device 118 and the second device 120 will see the same compliance. This causes these current sources to turn on at the same supply voltage so that there is no overshoot of VR as the supply voltage comes up. NMOS current source devices M14 and M15 of the first device 118 and the second device 120 will benefit from native or low Vt devices. This will lower required power supply voltage and incur no liability. In the voltage and current reference output 16 illustrated in FIG. 7, the PTAT current is delivered by M15 to mirror M13-M19-M20. The PTAT current is driven into R2-Q3 to produce the bandgap output in standard fashion. M20 provides a PTAT reference output current.

Figure 8:
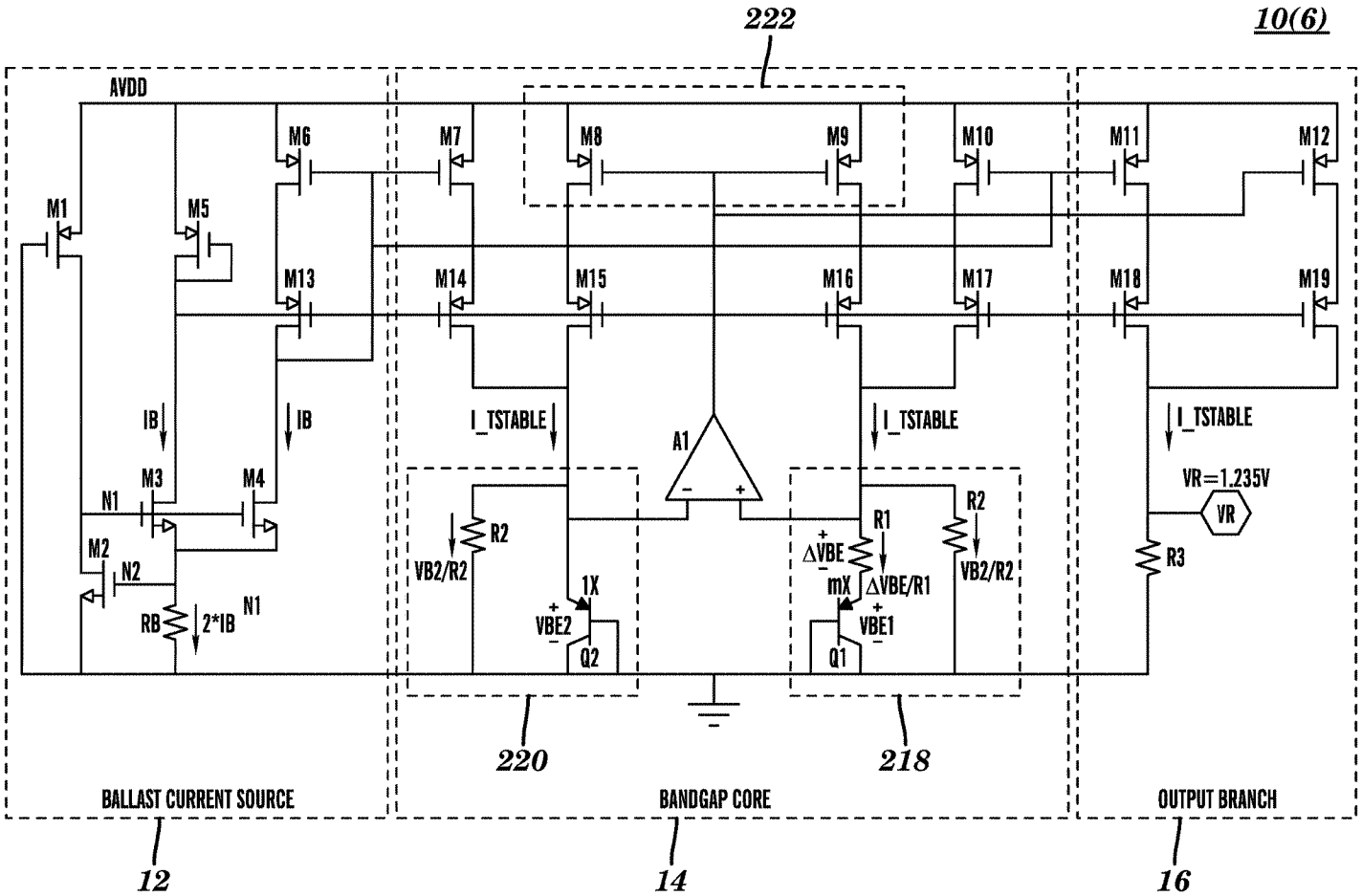
FIG. 8 is a circuit diagram of yet another exemplary modification of the CMOS self-starting bandgap reference circuit illustrated in FIG. 5 that provides a low voltage reference circuit.

FIG. 8 illustrates a low voltage CMOS version of the self-starting bandgap reference circuit 10(6). This circuit modification is analogous to common-mode feedback loops in fully-differential amplifiers that use a fixed current source to set output branch bias near the target and a small parallel current source under feedback control to set common-mode voltage. This example is compatible with standard CMOS applications, has low supply voltage requirements, utilizes PTAT core currents, and can be setup as a 1.2V or fractional reference.

The example illustrated in FIG. 8 employs a ballast current source for the bias current source 12. M1, M2, M3, M4 and RB of the bias current source 12 create a CMOS Vt referenced bias current. M2 is sized for very small overdrive so that its Vgs is nearly Vt and variability is reduced. M3 provides current to M5 which provides the cascode rail voltage. M4 provides current to mirror M6, M7, M10 and M11 which provide the core ballast and a fraction of the output current sources.

In this example, the ballast current source 12 drives current into core devices Q1 and Q2 of first device 218 and second device 220. This current is set at an amplitude that is lower than the design target servo current. The current mirror 222 formed by amplifier A1 and M8 and M9 delivers current in parallel with the ballast source 12. It introduces additional current to bring the core to its target bias point. The loop tracks temperature and process changes. Note that in the case of a reference that requires start-up, this start-up current must be introduced to wake-up the circuit and then turned off after start-up is reached. The turn-off is important because, if left on, the start-up current will shift the operating point and introduce errors. In contrast, this circuit uses ballast currents for the bias current source 12, which are a fraction of the intended bias level and remain on constantly. The feedback loop adds the remaining fraction of current required to reach the design target level. The ΔVBE signal is impressed across R1 making its current PTAT. The VBE voltage is impressed across R2 making its current CTAT. These resistors are ratioed such that the sum of their currents is temperature stable (T-stable).

The circuit 10(6) illustrated in FIG. 8 operates with a minimum voltage of the higher of: (1) a threshold voltage plus and overdrive plus a gate source (Vgs) drop in series, as required by the ballast current source 12, or (2) a bipolar base emitter drop (VBE) as required by the bandgap core 14 plus the NMOS current mirror compliance of one or two overdrives. The specific process and operating temperature will determine the minimum voltage. Since a bipolar VBE is necessary in a bandgap reference, and a current source must be available to drive it, a VBE drop plus a single over-drive voltage (output compliance voltage of a simple mirror) can be considered a minimum bandgap supply voltage. Since the core current must be mirrored out, two over-drives are used in the circuit 10(6) illustrated in FIG. 8 to obtain a high degree of matching and high output impedance. To obtain this matching and output impedance with a single over-drive would require additional electronics and associated power consumption. For these reasons, the supply voltage limit of the circuit is a reasonable minimum. However, for requirements that are less accurate, a simple mirror could be used with a single overdrive. In this example, the ballast current source 12 must be maintained between minimum and maximum limits to insure start-up, as described below.

In this example, both the ballast and A1 mirror currents are mirrored to the output branch. Since the sum is T-stable, the output branch resistor R3 can be chosen at any convenient value to scale the reference output voltage as needed. This includes the possibility of a fractional reference where the output voltage is set to 600 mV for example.

Figure 9:
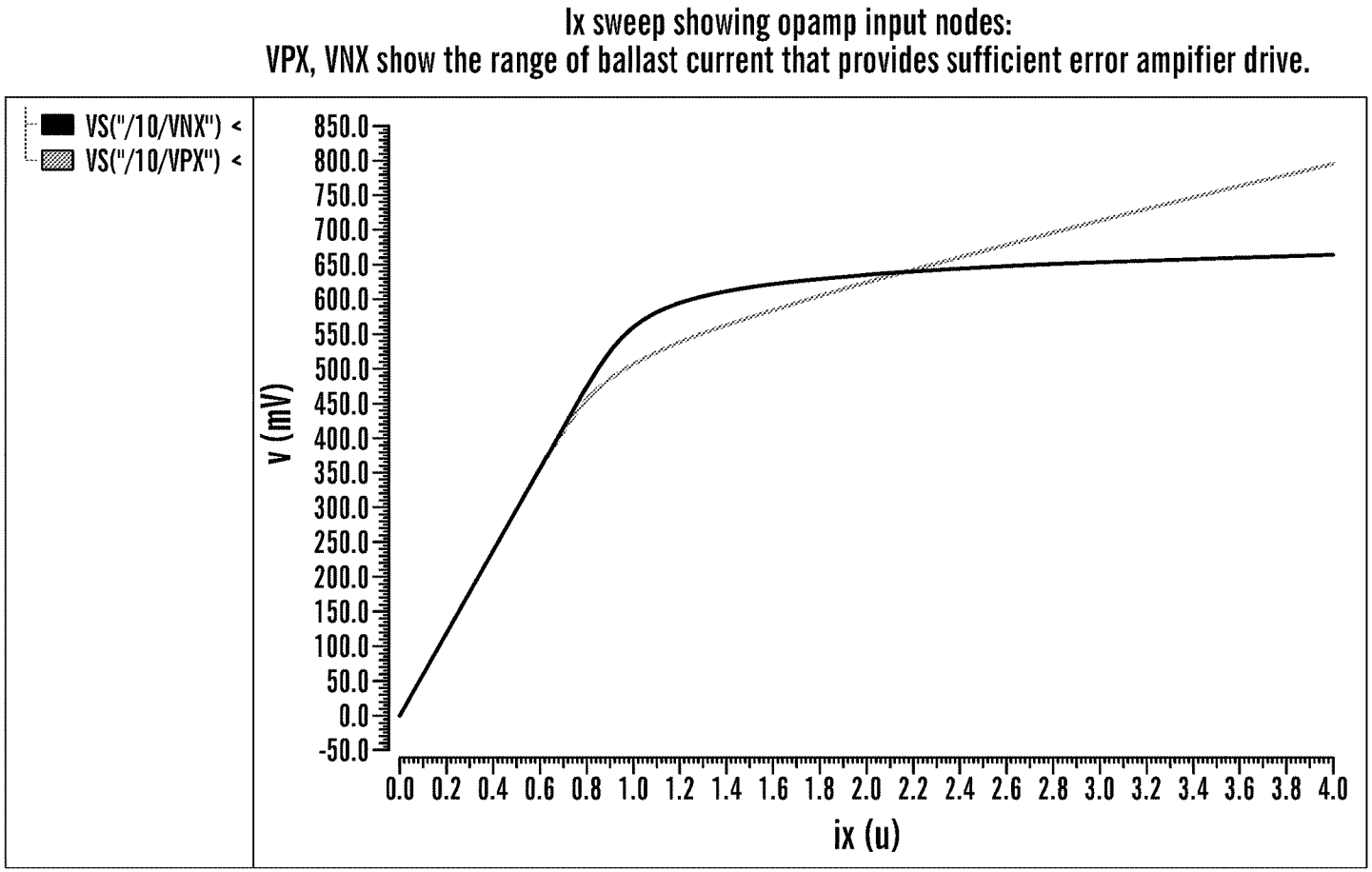
FIG. 9 is a graph illustrating the range of acceptable currents for the exemplary circuit illustrated in FIG. 8.

Ballast currents must be sufficiently small over all operating conditions, such that the amplifier always makes a contribution to the core currents. Otherwise its control of the loop is lost. (This constraint is not present in a start-up version, since these currents are shut down after start-up is achieved). These considerations determine the range of suitable ballast currents for the bias current source 12. By driving identical currents into both amplifier input nodes and sweeping this current, the above described behavior is clearly seen and a plot of this behavior informs the choice of ballast current. FIG. 9 illustrates a graph of the range of acceptable currents. As long as the ballast current magnitude from the bias current source 12 is kept within this range, start-up is assured. As shown in FIG. 9, the vertical axis gives amplifier input voltages while the independent axis is the current driven into the inverting and non-inverting nodes. For this design, ballast currents below roughly 0.8 uA show identical input voltages and will fail to start this circuit. The crossover point at just below 2.2 uA is the design target; it must be reached by drive from the amplifier so ballast current must be set below this level. Above the 2.2 uA level the loop will lose control and the function of the reference circuit is lost. A ballast current in the center of this 1.4 uA range can be chosen and then checked for variation. The plot in FIG. 9 will vary of course over process, supply, temperature and mismatch. Both this plot and the ballast current stability can be run over PVT and Monte Carlo to check the choice of design center target. Trim of the ballast resistor can be used if the spread is too wide.

Figure 10:
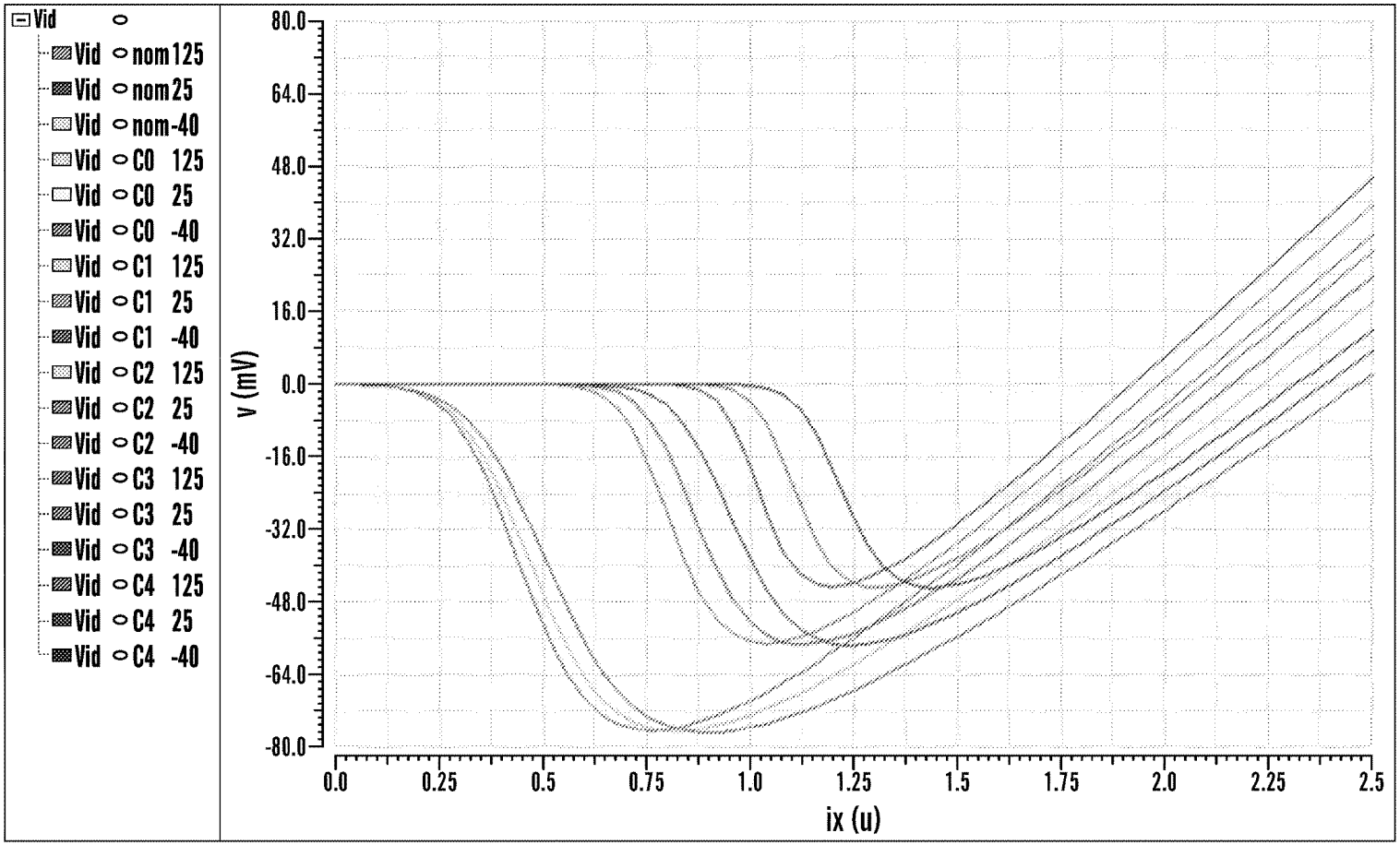
FIG. 10 is a graph illustrating a corner and temperature simulation of amplifier input difference (Vid) under current drive.

FIG. 10 shows corner and temperature simulations of the Banba input under current drive. The region below the zero axis from 1.1 uA to 1.9 uA represent the possible range valid of ballast currents. If a center value of roughly 1.5 uA is chosen, a reasonable margin is obtained—above the minimum start-up current and below the 2.0 uA design target. This insures that the amplifier contributes core current under all conditions and drives the loop to the desired operating point. The ballast source corners must be checked to insure it delivers current in this range. Monte Carlo mismatch simulations are expected to show small variations as they depend on wide poly resistors and bipolar device variation.

Figure 11:
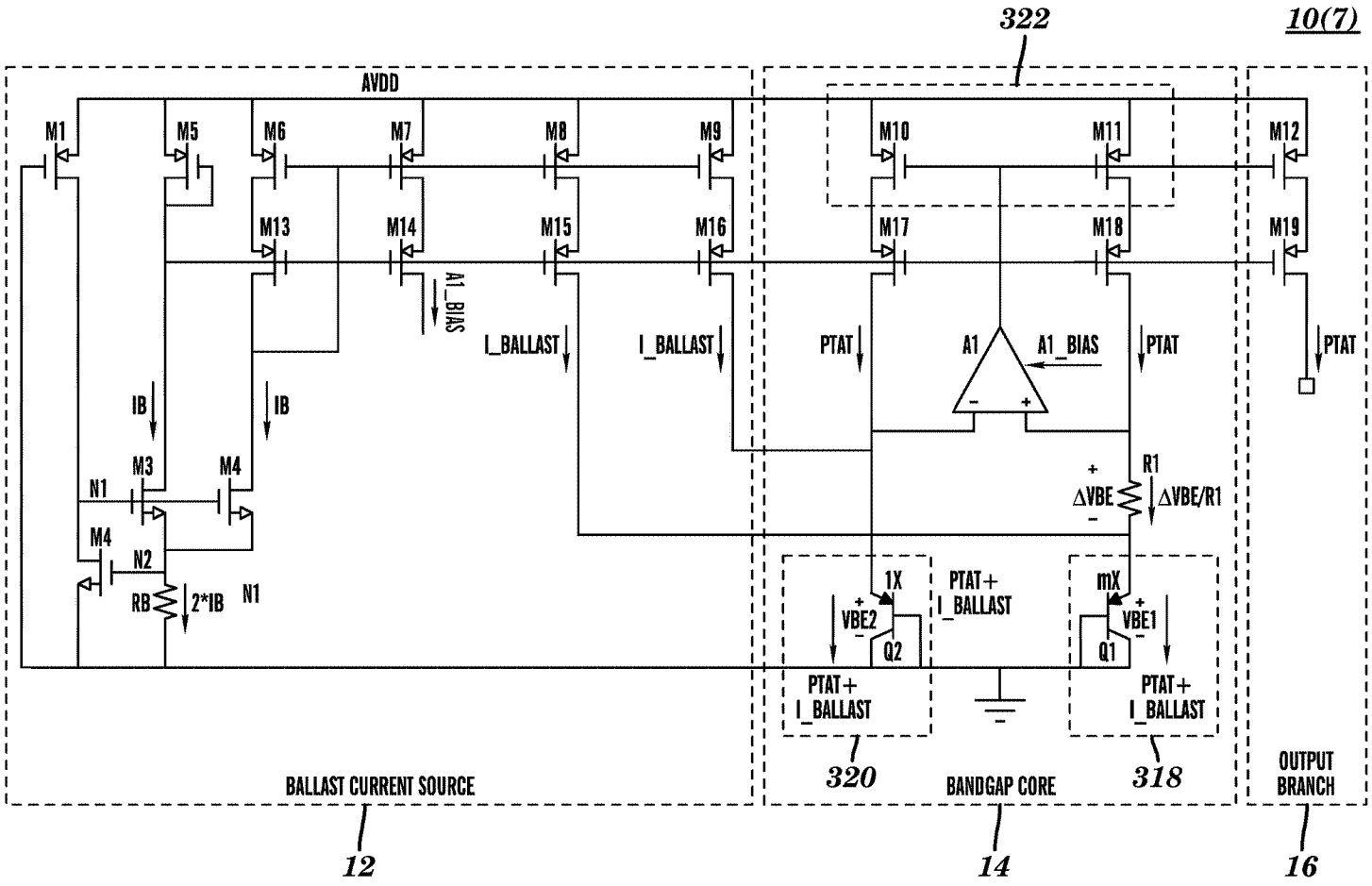
FIG. 11 is a circuit diagram of a further exemplary modification of the CMOS self-starting bandgap reference circuit illustrated in FIG. 8 that provides a low voltage reference circuit.

FIG. 11 illustrates another low voltage CMOS version of a self-starting bandgap reference circuit 10(7). This circuit may be utilized for contemporary deep-submicron CMOS processes that require low supply voltages, by way of example. The circuit in FIG. 11 employs a ballast current source 12 similar to the ballast current source utilized in the circuit 10(6) of FIG. 8 to create a current that starts reliably. However, the circuit illustrated in FIG. 11 eliminates the ballast current boundaries discussed above with respect to FIG. 8.

Referring again to FIG. 11, the ballast current source 12 provides ballast currents of sufficient magnitude, over all operating conditions, to insure start-up. Thus, a ballast current can be chosen that is comfortably in excess of the minimum without impacting start-up and having a very small impact on power supply requirements. The ballast current source 12 is based on the CMOS gate source voltgate (Vgs) of M2, which is sized top provide a small over-drive. This makes Vgs nearly equal to the CMOS threshold Vt to create a lower voltage that is more stable over process corners. Pull-up device M1 is sized to operate in triode mode and provides a reliable current for M2. The resulting current in the bias resistor (RB) is given by the equation:

$$RB=2*IB=Vt/RB \tag{16}$$

This current is split by cascode devices M3 and M4, which provide current to the PMOS mirror reference and its associated cascode device. The ballast current is mirrored out by M7, M8 and M9 to provide a reliable bias for servo amplifier A1 as well as two ballast currents.

The ballast currents advantageously cannot fail to turn on, do not turn off while the circuit operates, and impart no deleterious impact as a result of the continuous operation of ballast currents. The core mirror operates consistently at a current defined by (ΔVBE/R) as desired. As shown in FIG. 11, equal ballast currents (I_BALLAST) are driven into bipolar PNP devices Q1 and Q2 of a first device 318 and a second device 320. Although PNP devices are illustrated, it is to be understood that NPN devices could also be utilized for Q1 and Q2 with no change in circuit operation.

When no current, or currents of small magnitude, are available from the core mirror 322 (M10 and M11), the drop across the resistor R1 will be small. Since equal ballast currents are driven into Q1 and Q2 of the first device 318 and the second device 320, the device with a ratio of "m" greater area (Q1) will have a smaller voltage drop than Q2. As a result, the positive input of the servo amplifier A1 is at a lower voltage than the negative input and the output from servo amplifier A1 drives downward. This causes PMOS mirror 322 (M10-M11) to deliver current to the core. Alternatively, when excess current flows in the core, the drop across R1 increases, and the output of servo amplifier A1 drives upward and the core currents decrease. The loop drives from any other condition to one of equal voltages at the opamp input. As a result, the core must start with continuous ballast current applied to the bipolar devices of first device 318 and second device 320 (Q1 and Q2).

When the inputs on servo amplifier A1 are driven to equal voltages, the difference in base-emitter voltages (ΔVBE) appears across R1 so that it carries a PTAT current equal to (ΔVBE/R1). This PTAT current is mirrored by the high-compliance mirror 322 comprised of M10-M11 and A1. This means the bipolar devices both carry a current equal to (ΔVBE/R1)+I_BALLAST. Thus, ΔVBE is independent of collector currents over several decades of current. In this example, the collector currents must be equal. The PTAT reference current output is mirrored out by device M12, which is cascoded by M19 for tight matching and high output impedance. This circuit advantageously eliminates the problem of double boundaries on the ballast current. Thus, the circuit illustrated in FIG. 11 provides a low voltage self-starting PTAT current reference circuit 10(7) that is both more rugged and easier to implement.

Figure 12:
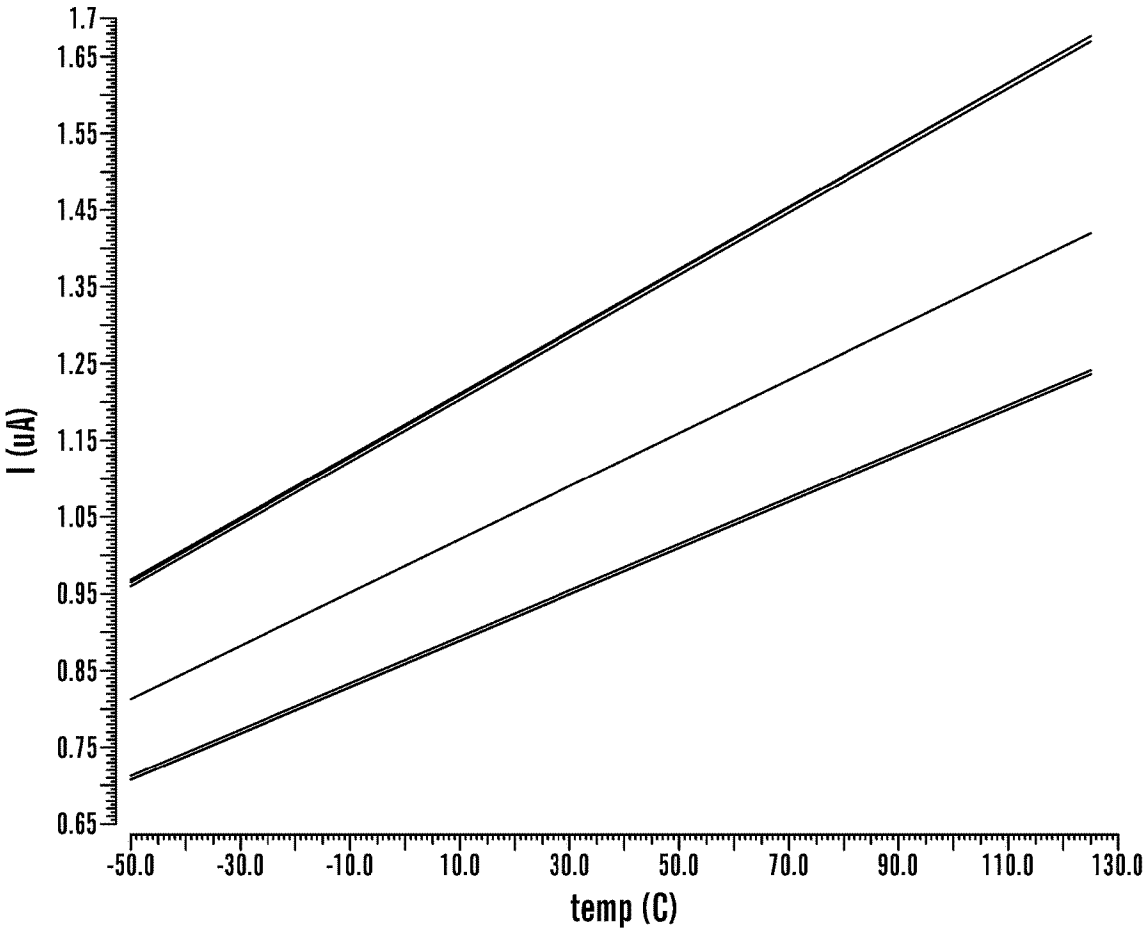
FIG. 12 is a chart of temperature versus current for a test circuit in accordance with FIG. 11.
Figure 13:
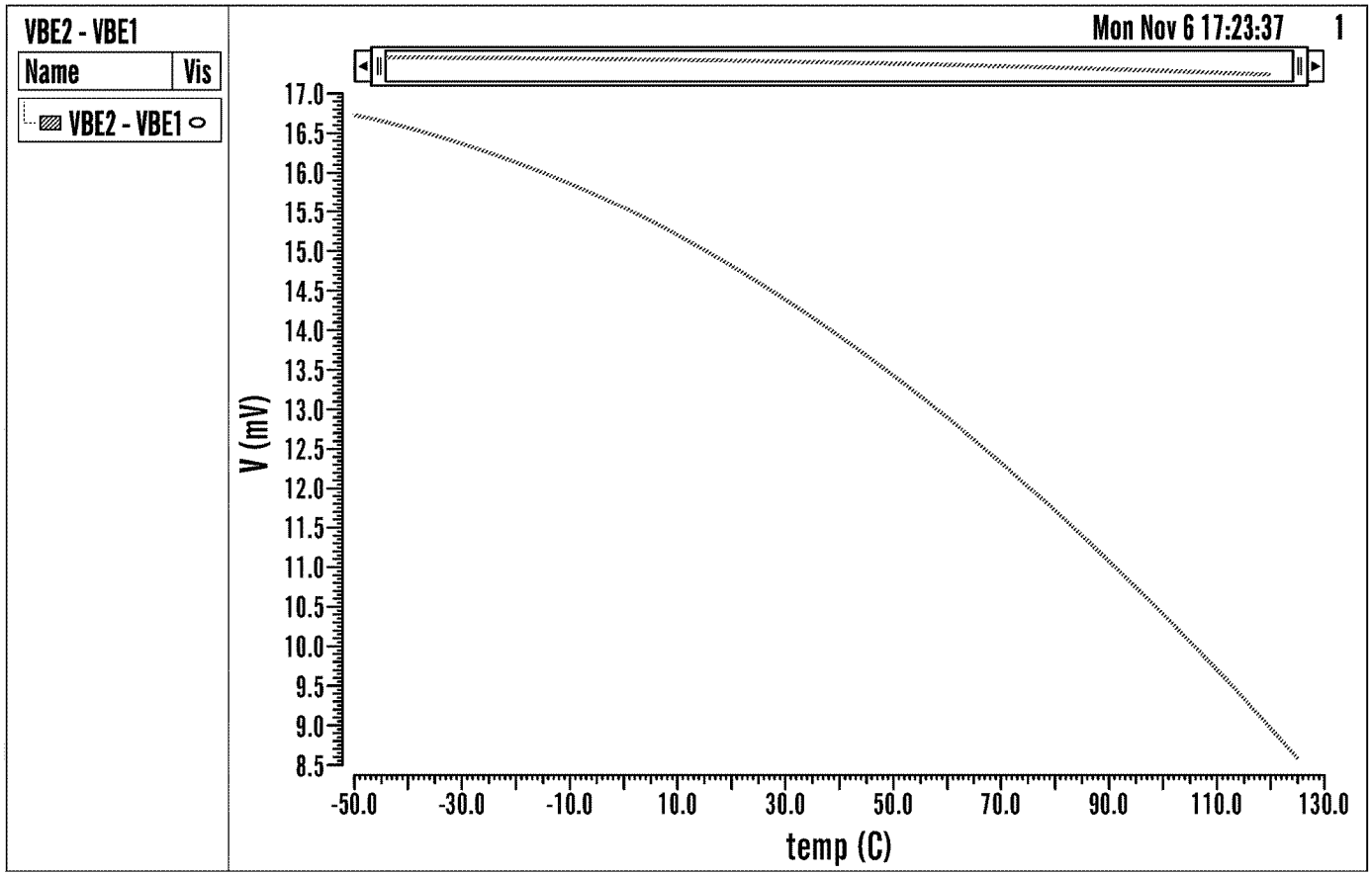
FIG. 13 illustrates the difference in voltage requirements for a PTAT bipolar current as opposed to the PTAT and I_ballast bias used in FIG. 11 for the test circuit.

FIG. 12 illustrates the output current versus temperature for an exemplary test circuit in accordance with the circuit 10(7) illustrated in FIG. 11. FIG. 13 illustrates the difference in voltage requirements for a PTAT bipolar current as opposed to the PTAT and I_ballast bias used in FIG. 11 for the test circuit. As shown in FIG. 13, the test circuit bipolar devices, first device 318 and second device 320, carried the core PTAT current plus the ballast current (I_ballast), as described above. An additional bipolar diode was included in the simulation and driven with the core PTAT current alone. The difference was plotted over temperature and shows only an additional 17 mV of supply voltage required. This circuit was run over corners and temperature to test start-up and started reliably in every case. The log compression of the bipolar devices makes the additional voltage displayed in FIG. 13 negligible.

Figure 14:
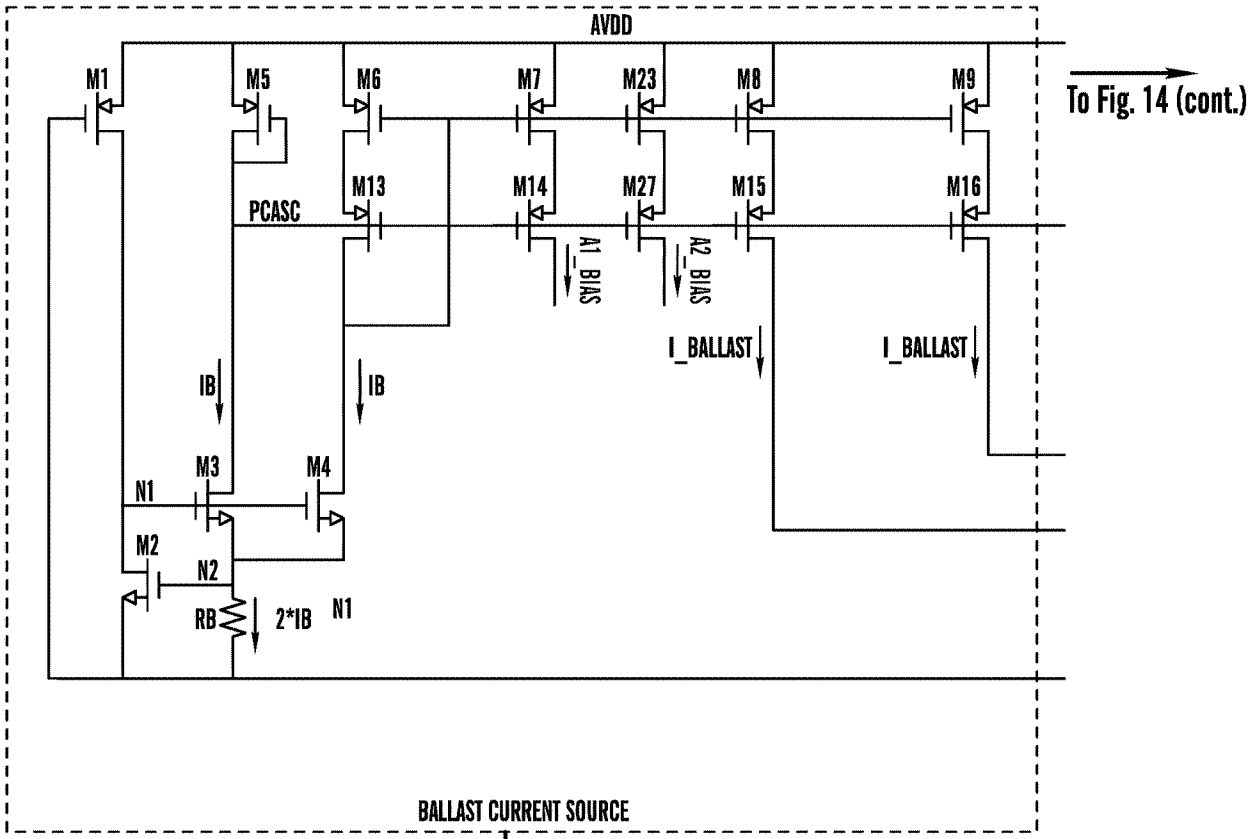
FIG. 14 is a circuit diagram of an exemplary modification of the CMOS self-starting bandgap reference circuit illustrated in FIG. 11.
Figure 14:
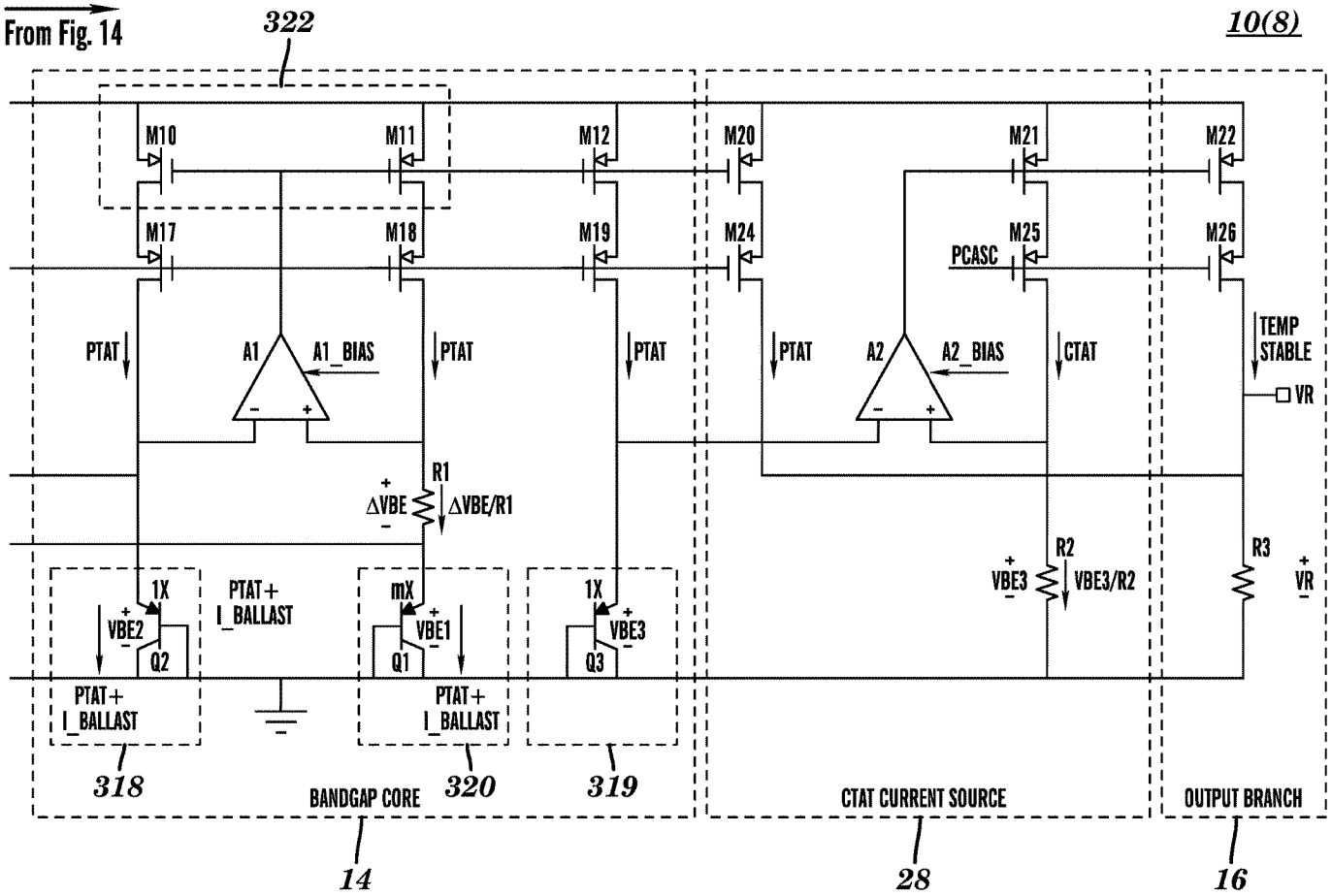
Figure 15:
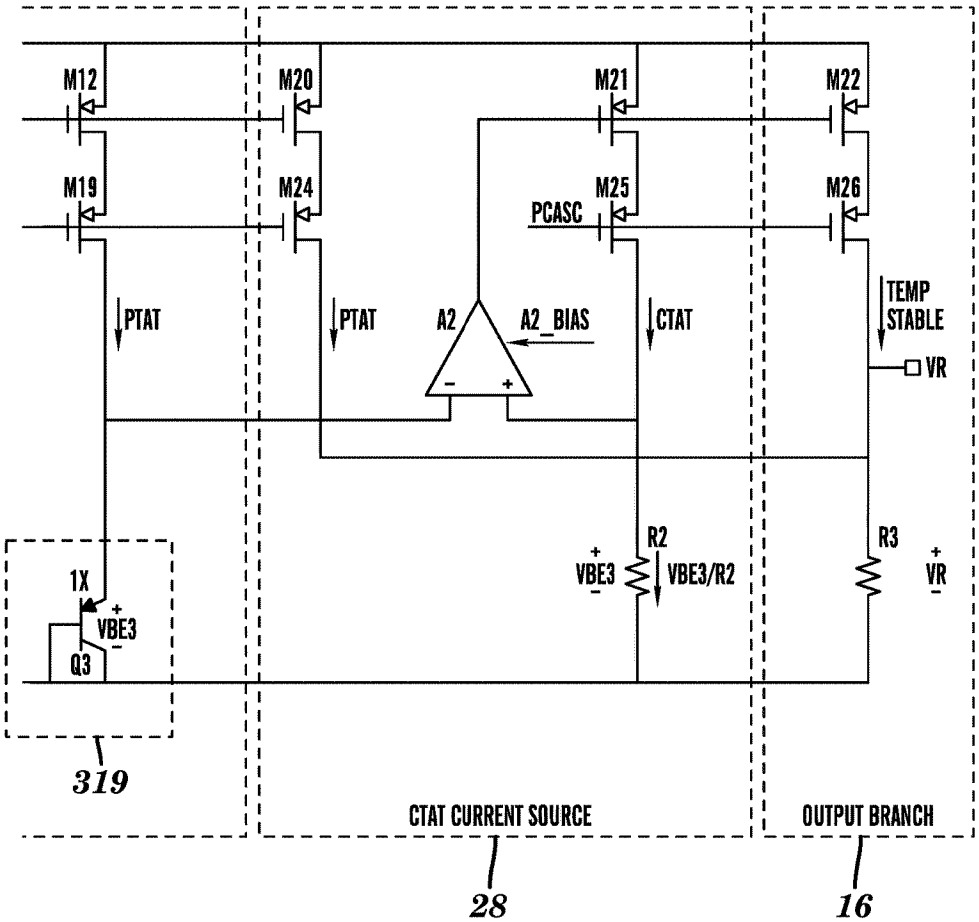
FIG. 15 is a circuit diagram of the CTAT current source and output branch illustrated in FIG. 14.

FIGS. 14 and 15 illustrate another exemplary self-starting low voltage bandgap reference circuit 10(8) that is an extension of the circuit 10(7) illustrated in FIG. 11. In this example, the ballast current source 12 section is identical to the circuit of FIG. 11. The bandgap core 14 includes an additional 1× bipolar device (Q3) of third device 319 that is driven with a PTAT current from mirror M12 in order to provide a VBE input voltage for amplifier A2. The PTAT output current is driven through the bipolar device (Q3) of third device 319. Although not illustrated, a trim could be added to the circuit 10(8) for increased accuracy. The PTAT current may be mirrored out as a bias reference.

Figure 16:
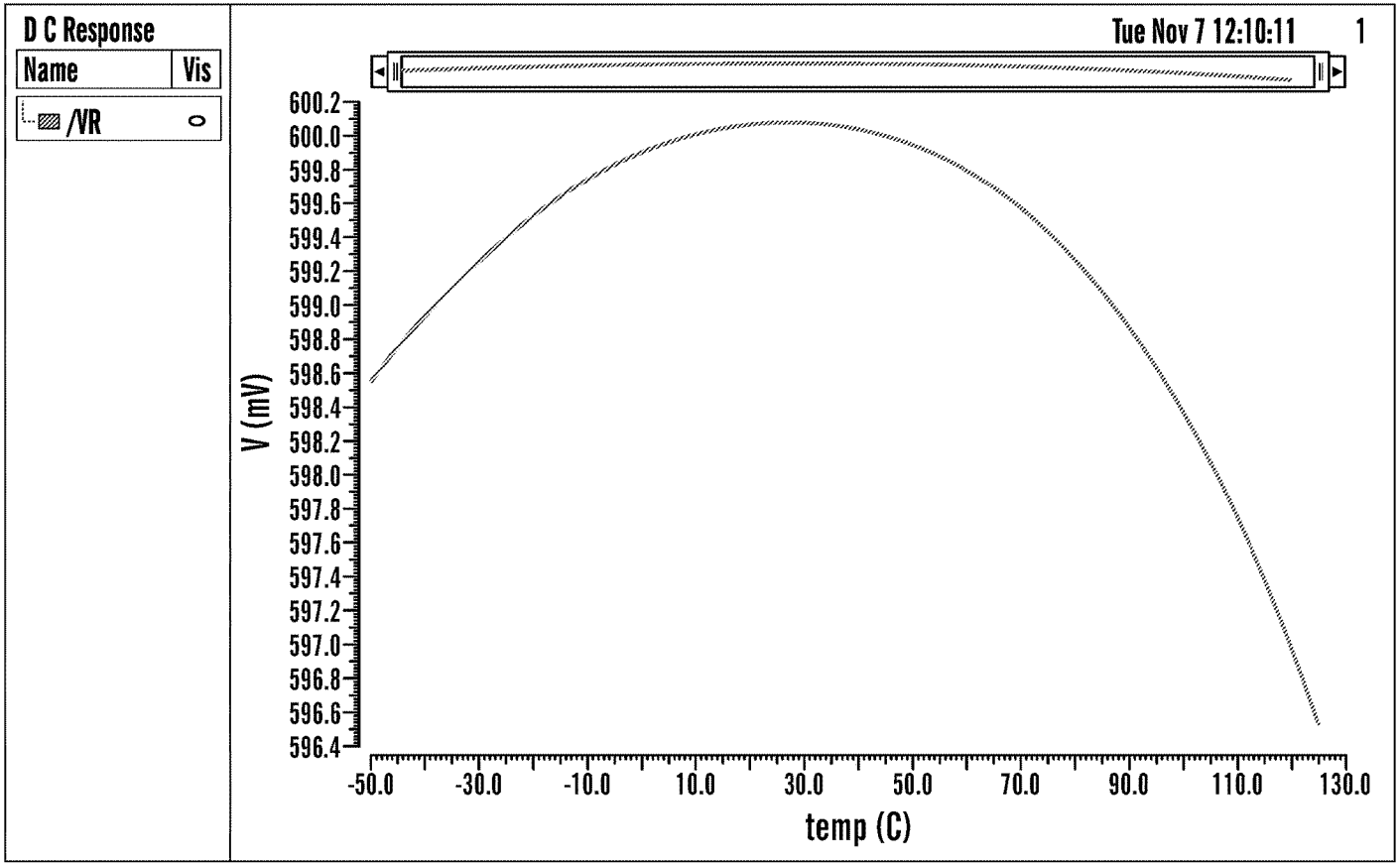
FIG. 16 is a chart of temperature versus voltage for a test circuit in accordance with FIGS. 14 and 15.
Figure 17:
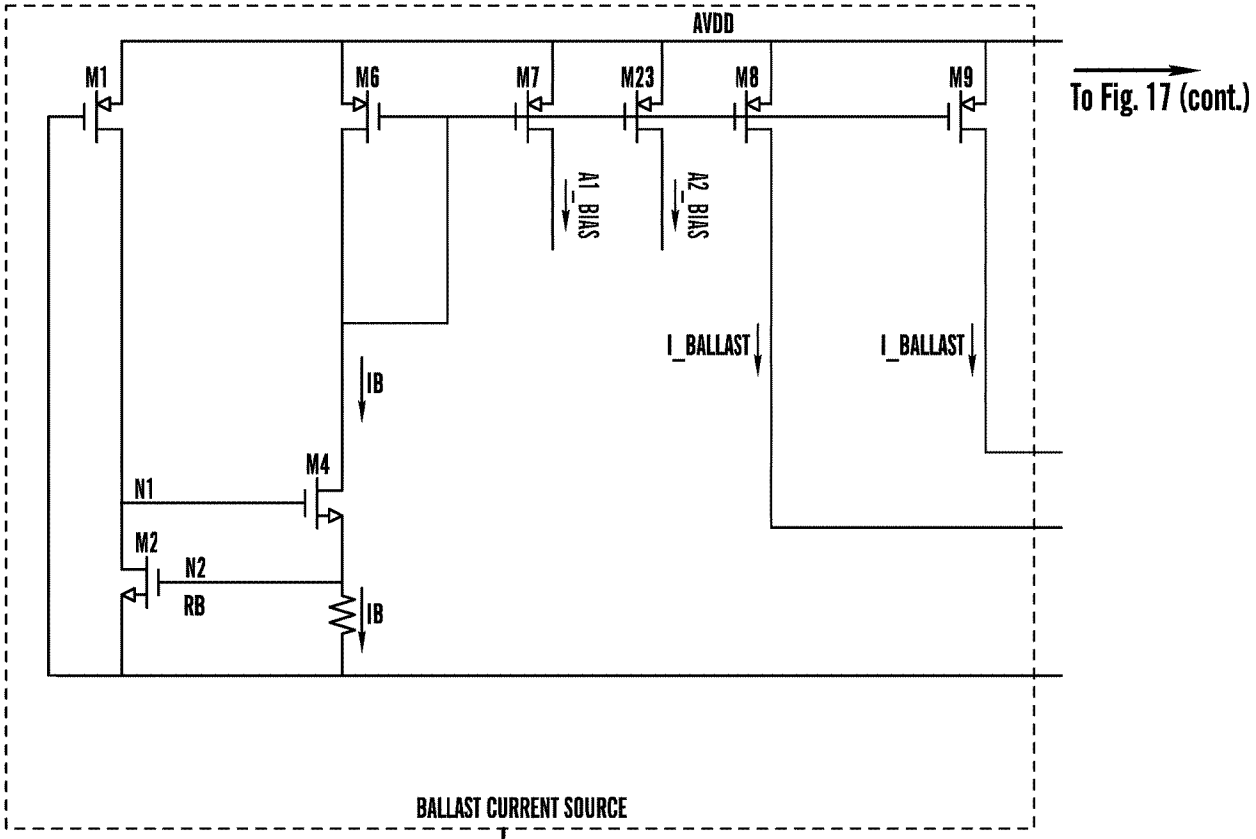
FIG. 17 is a circuit diagram of an exemplary modification of the CMOS self-starting bandgap reference circuit illustrated in FIGS. 14 and 15.
Figure 17:
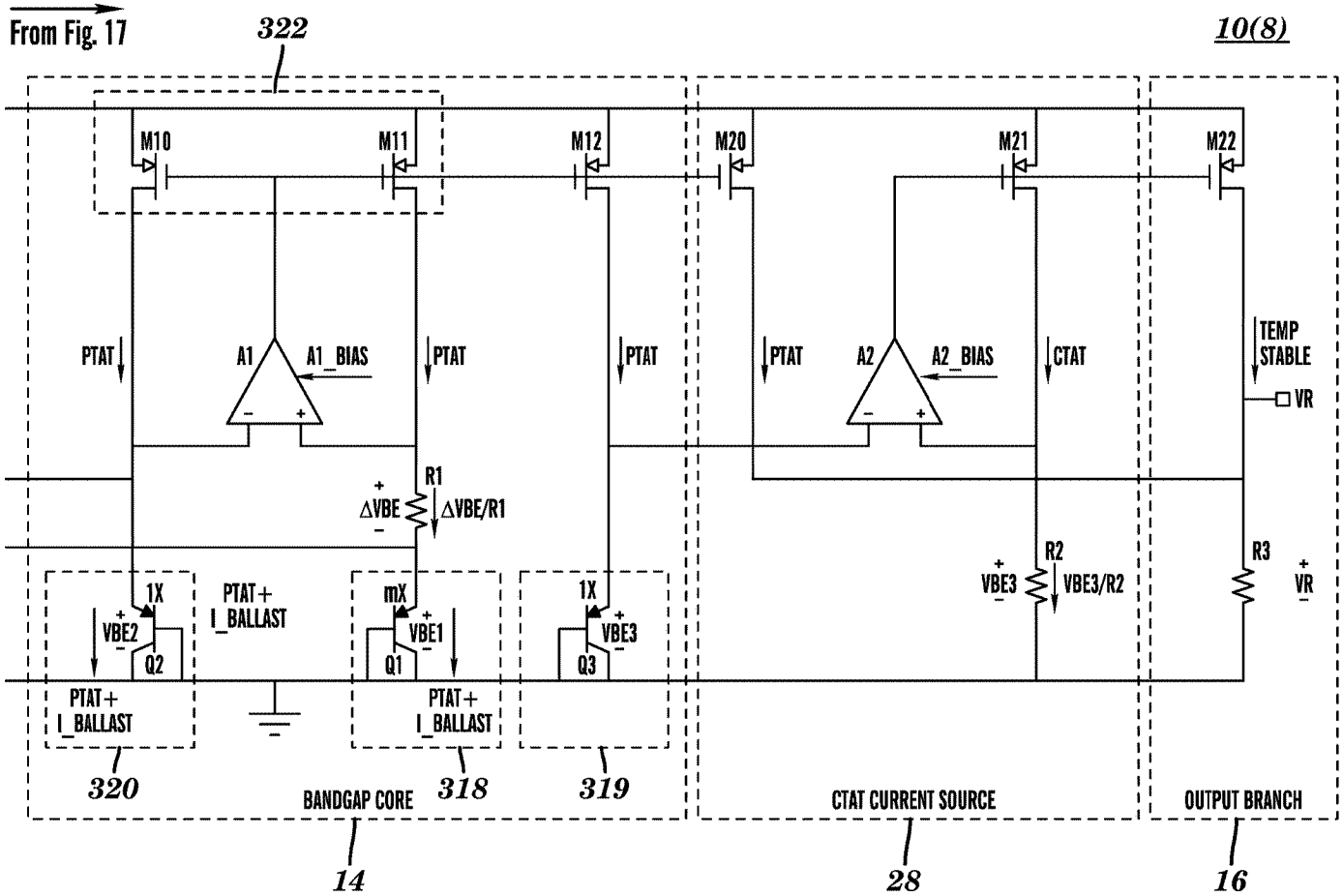

The circuit 10(8) further includes a CTAT current source 28 prior to the output branch. The CTAT current source 28 takes the base-emitter voltage of Q3 of third device 319 (VBE3) as an input. The voltage-to-current converter comprised of amplifier A2 and PMOS device M21 drives current through R2 such that base-emitter voltage of Q3 (VBE3) appears across R2. The resulting Complimentary to Absolute Temperature (CTAT) current equal to (VBE3/R2) is generated and mirrored to R3 by M22. The PTAT current is also mirrored by M20 to R3. Current through R3 then is the sum of the PTAT and the CTAT currents. This current is scaled to be temperature-stable by the PTAT gain ratio of (R2/R1) and the resulting reference voltage appears across R3. Since the R3 current is stable with temperature, this is a fractional bandgap reference and R3 can be scaled to produce any convenient reference voltage magnitude that is within compliance of the output current mirror. FIG. 16 illustrates the voltage versus temperate for a test circuit in accordance with the circuit illustrated in FIGS. 14 and 15. FIG. 17 illustrates an alternative example of the circuit 10(8) illustrated in FIGS. 14 and 15 that employs a simple mirror for reduced power supply requirements.

Accordingly, examples of the present technology provide self-starting bandgap reference circuits that advantageously provide a stable voltage reference that is independent of supply voltage and temperature. The circuit forms the basis for Analog-to-Digital conversion, as well as a basis to create stable power supply voltages and bias currents. The circuit provides a single stable state when powered with no undesired zero-current or zero-voltage state, thus eliminating the requirement for a start-up circuit. Specifically, the circuits of the present technology put the core devices in current drive with a sure-starting current source.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A self-starting bandgap reference circuit comprising:

a bias current source configured to provide a bias current;

a bandgap core coupled to the bias current source, the bandgap core comprising:

a first device configured to receive the bias current and provide a first current output based on the bias current; and a second device configured to receive the bias current and provide a second current output based on the bias current;

a difference mirror coupled to the first device and the second device to receive the first current output and the second current output, the difference mirror configured to provide a difference current between the second current output and the first current output, wherein the difference current is a proportional-to-absolute temperature current; and a voltage reference output and a current reference output coupled to the difference mirror to receive the proportional-to-absolute temperature current and provide a voltage reference and a current reference based on the proportional-to-absolute temperature current.

2. The self-starting bandgap reference circuit as set forth in claim 1, wherein the first current output is proportional to a first base emitter voltage for the first device and the second current output is proportional to a second base emitter voltage for the second device.

3. The self-starting bandgap reference circuit as set forth in claim 2, wherein the first current output is equal to the first base emitter voltage divided by a first resistance of a first resistor in the first device and the second current output is equal to the second base emitter voltage divided by a second resistance of a second resistor in the second device.

4. The self-starting bandgap reference circuit as set forth in claim 3, wherein the first resistance is equal to the second resistance.

5. The self-starting bandgap reference circuit as set forth in claim 1, wherein a second emitter area of the second device is larger than a first emitter area of the first device.

6. The self-starting bandgap reference circuit as set forth in claim 1, wherein the first current output is delivered to an input of the difference mirror and the second current output is delivered to an output of the difference mirror.

7. The self-starting bandgap reference circuit as set forth in claim 1, wherein the first device and the second device comprise bipolar transistors.

8. The self-starting bandgap reference circuit as set forth in claim 1 further comprising:

a proportional-to-absolute temperature current generator circuit coupled to the bias current source, the proportional-to-absolute temperature current generator circuit configured to receive the bias current and provide a pair of proportional-to-absolute temperature current outputs, wherein the pair of proportional-to-absolute temperature current outputs are provided to bias the bandgap core.

9. The self-starting bandgap reference circuit as set forth in claim 1, where the bias current is a self-starting bias current.

10. A method of making a self-starting bandgap reference circuit comprising:

providing a bias current source configured to provide a bias current;

coupling a bandgap core to the bias current source, the bandgap core comprising:

a first device configured to receive the bias current and provide a first current output based on the bias current; and a second device configured to receive the bias current and provide a second current output based on the bias current;

coupling a difference mirror to the first device and the second device to receive the first current output and the second current output, the difference mirror configured to provide a difference current between the second current output from the first current output, wherein the difference current is a proportional-to-absolute temperature current; and coupling a voltage reference output and a current reference output to the difference mirror to receive the proportional-to-absolute temperature current and provide a voltage reference and a current reference based on the proportional-to-absolute temperature current.

11. The method as set forth in claim 10, wherein the first current output is proportional to a first base emitter voltage for the first device and the second current output is proportional to a second base emitter voltage for the second device.

12. The method as set forth in claim 11, wherein the first current output is equal to the first base emitter voltage divided by a first resistance of a first resistor in the first device and the second current output is equal to the second base emitter voltage divided by a second resistance of a second resistor in the second device.

13. The method as set forth in claim 12, wherein the first resistance is equal to the second resistance.

14. The method as set forth in claim 10, wherein a second emitter area of the second device is larger than a first emitter area of the first device.

15. The method as set forth in claim 10, wherein the first current output is delivered to an input of the difference mirror and the second current output is delivered to an output of the difference mirror.

16. The method as set forth in claim 10, wherein the first device and the second device comprise bipolar transistors.

17. The method as set forth in claim 10 further comprising:

coupling a proportional-to-absolute temperature current generator circuit to the bias current source, the proportional-to-absolute temperature current generator circuit configured to receive the bias current source and provide a pair of proportional-to-absolute temperature current outputs, wherein the pair of proportional-to-absolute temperature current outputs are provided to bias the bandgap core.

18. The method as set forth in claim 10, wherein the bias current is a self-starting bias current.

* * * * *